US008909087B2

(12) United States Patent
Unno

(10) Patent No.: US 8,909,087 B2
(45) Date of Patent: Dec. 9, 2014

(54) PRINTING SYSTEM, JOB PROCESSING METHOD, STORAGE MEDIUM, AND PRINTING APPARATUS

(75) Inventor: Kouichi Unno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 11/767,253

(22) Filed: Jun. 22, 2007

(65) Prior Publication Data

US 2008/0003011 A1 Jan. 3, 2008

(30) Foreign Application Priority Data

Jun. 30, 2006 (JP) ..... 2006-182579
Apr. 12, 2007 (JP) ..... 2007-104455

(51) Int. Cl.
*G03G 15/00* (2006.01)

(52) U.S. Cl.
CPC .. *G03G 15/6508* (2013.01); *G03G 2215/00729* (2013.01); *G03G 2215/00109* (2013.01); *G03G 15/502* (2013.01)
USPC ..... 399/85; 399/87; 399/391

(58) Field of Classification Search
USPC ..... 399/75–77, 81–83, 85, 87, 391
See application file for complete search history.

(56) References Cited

U.S. PATENT DOCUMENTS

| | | | | |
|---|---|---|---|---|
| 5,895,142 | A * | 4/1999 | Takahashi et al. | 399/85 |
| 6,775,488 | B2 * | 8/2004 | Sawada | 399/45 |
| 2006/0029413 | A1 * | 2/2006 | Kagita | 399/81 |
| 2006/0188284 | A1 * | 8/2006 | Ikeda | 399/82 |
| 2006/0291888 | A1 * | 12/2006 | Miyamoto et al. | 399/81 |
| 2007/0047979 | A1 * | 3/2007 | Ai | 399/23 |

FOREIGN PATENT DOCUMENTS

| | | | |
|---|---|---|---|
| JP | 11-157681 | A | 6/1989 |
| JP | 07-179250 | A | 7/1995 |
| JP | 2000-143017 | A | 5/2000 |
| JP | 2004-310746 | A | 11/2004 |
| JP | 2004-310747 | A | 11/2004 |
| JP | 2005-162419 | A | 6/2005 |
| JP | 2007-065323 | A | 3/2007 |

* cited by examiner

*Primary Examiner* — Walter L Lindsay, Jr.
*Assistant Examiner* — Barnabas Fekete
(74) *Attorney, Agent, or Firm* — Canon USA Inc IP Division

(57) ABSTRACT

A printing system is operable to enable a printing apparatus to continue a printing of a print job by using printing media of a second supply source after using printing media of a first supply source without expending all of printing media of the first supply source. The printing media included in the first supply source are the same size and type as the printing media included in the second supply source.

8 Claims, 28 Drawing Sheets

FIG.15

2501

| JOB ID (2502) | TYPE (2503) | PAPER FEED UNIT (2504) | PAPER FEED UNIT OPTION SETTING (2505) | NUMBER OF PRINTS (2506) | SADDLE STITCH BINDING SETTING (2507) | CASE BINDING SETTING (2508) | PAPER DISCHARGE DESIGNATION (2509) |
|---|---|---|---|---|---|---|---|
| 01 | COPY | 1 | PRIORITIZE PRODUCTIVITY | 100 | NO | NO | SHIFT SORTING STACKING TRAY |
| 02 | COPY | 3 | NORMAL | 5 | NO | YES | — |
| 03 | PDL | 2 | PRIORITIZE PRODUCTIVITY | 500 | NO | NO | STACKER |
| ... | ... | ... | ... | ... | ... | ... | ... |

FIG.20

3002 3005

| PAPER FEED UNIT | SIZE | PAPER TYPE | PRODUCTIVITY PRIORITIZED SETTING |
|---|---|---|---|
| 01 | A4 | PLAIN PAPER | PRODUCTIVITY PRIORITIZED |
| 02 | A3 | THICK PAPER | NORMAL |
| 03 | A4 | FINE QUALITY PAPER | PRODUCTIVITY PRIORITIZED |
| 04 | A4 | TAB PAPER | NORMAL |
| 05 | LTR | ... | ... |
| 06 | STMT | ... | ... |
| 07 | 11×17 | ... | ... |
| 08 | ... | | |
| 09 | ... | | |
| 10 | ... | | |
| 11 | ... | | |

3001

FIG.23

3303 3304 3305 3306 3307 3308

| ID | NAME | GRAMMAGE | SURFACE CHARACTERISTICS | SHAPE | COLOR | PRODUCTIVITY PRIORITIZED SETTING |
|---|---|---|---|---|---|---|
| 01 | TEXT | 105 | PLAIN PAPER | NORMAL | WHITE | PRODUCTIVITY PRIORITIZED |
| 02 | COVER | 200 | COATED PAPER | NORMAL | RED | NORMAL |
| 03 | TEXT | 105 | PLAIN PAPER | NORMAL | WHITE | PRODUCTIVITY PRIORITIZED |
| 04 | TAB PAPER | 150 | COATED PAPER | TAB PAPER | BLUE | NORMAL |
| 05 | TEXT | ... | ... | ... | ... | ... |
| 06 | SLIP SHEET | ... | ... | ... | ... | ... |
| 07 | ... | ... | ... | ... | ... | ... |
| ... | ... | | | | | |
| ... | ... | | | | | |
| ... | ... | | | | | |
| 199 | ... | | | | | |

3301

FIG.25

| PAPER FEED UNIT | SIZE | ID | GRAMMAGE | SURFACE CHARACTERISTICS | SHAPE | COLOR | PRODUCTIVITY PRIORITIZED SETTING |
|---|---|---|---|---|---|---|---|
| 01 | A4 | 01 | 105 | PLAIN PAPER | NORMAL | WHITE | PRODUCTIVITY PRIORITIZED |
| 02 | A3 | 02 | 200 | COATED PAPER | NORMAL | RED | NORMAL |
| 03 | A4 | 01 | 105 | PLAIN PAPER | NORMAL | WHITE | PRODUCTIVITY PRIORITIZED |
| 04 | A4 | 04 | 150 | COATED PAPER | TAB PAPER | BLUE | NORMAL |
| 05 | LTR | 01 | 105 | PLAIN PAPER | NORMAL | WHITE | PRODUCTIVITY PRIORITIZED |
| 06 | ... | ... | ... | ... | ... | ... | ... |
| 07 | ... | ... | ... | ... | ... | ... | ... |
| 08 | ... | | | | | | |
| 09 | ... | | | | | | |
| 10 | ... | | | | | | |
| 11 | ... | | | | | | |

3501

FIG.26

STORAGE MEDIUM SUCH AS FD/CD-ROM

| DIRECTORY INFORMATION |
| --- |
| PROGRAM CODE CORRESPONDING TO STEPS IN FLOW CHART OF FIG. 11 |
| PROGRAM CODE CORRESPONDING TO STEPS IN FLOW CHART OF FIG. 12 |
| PROGRAM CODE CORRESPONDING TO CONTROL OF SETTING IN WHICH PRODUCTIVITY IS PRIORITIZED PERFORMED VIA UI ILLUSTRATED IN FIGS. 13, 14, 16, 18, 19, 21, 22, AND 24 |
| PROGRAM CODE CORRESPONDING TO CONTROL OF SETTING IN WHICH PRODUCTIVITY IS PRIORITIZED PERFORMED VIA UI ILLUSTRATED IN FIG. 17 |
| |

PRINTING SYSTEM, JOB PROCESSING METHOD, STORAGE MEDIUM, AND PRINTING APPARATUS

BACKGROUND OF THE INVENTION

1. Field of the Invention

The present invention relates to a printing system, a job processing method, a storage medium, and a printing apparatus.

2. Description of the Related Art

In the printing industry, conventionally, a print product is issued after various operations and processing are performed. The various operations and processing include, for example, input of an original document, designing of the original document, editing of a layout, a comprehensive layout (presentation by printing), proofreading (correction of the layout and color), proof printing, generation of block copy, printing, post-processing, and dispatching.

In the conventional printing industry, an offset platemaking and printing machine has been used. Accordingly, it is necessary to perform processing for generating a block copy. However, once a block copy is generated, it is not easy to correct the generated block copy. Thus, correction of a block copy requires high costs.

Accordingly, in generating a block copy, intensive proofreading (namely, close checking of a layout and colors) is required. Thus, a long proofreading time may be required before a print product is issued. Furthermore, a large-scale apparatus is used in each processing and a user (operator) of the apparatus is required to have an exclusive professional knowledge. Thus, a skilled user having knowledge about how to operate the large-scale apparatus is required in operating such apparatus.

Under these circumstances, in recent years, a Print On Demand (POD) printing system utilizing an electrophotographic printing apparatus or an inkjet printing apparatus has been proposed (see Japanese Patent Application Laid-Open NO. 2004-310746 and Japanese Patent Application Laid-Open NO. 2004-310747). Using such a POD printing system, processing for generating a block copy and other complicated operations become unnecessary.

However, in marketing such POD printing systems, there are some matters to be considered and solved.

For example, in a printing system for the POD market, improvement of the productivity has been regarded as important. In marketing products for the POD market, it is considered important to prevent downtime from occurring.

In this regard, a conventional printing system includes an auto cassette change (ACC) function. With the ACC function, after paper sheets necessary for printing and stacked in a paper feed unit are completely consumed, the print operation can be continued using paper sheets in another paper feed unit.

In a printing system having the above-described configuration, the following operation, for example, can occur.

(1) In order to feed paper necessary for a print operation, the printing system attempts to pick up paper sheets from a paper feed unit.

(2) As a result, the printing system detects that no paper is present in the paper feed unit.

(3) According to the detection result, after completely performing printing on the paper sheets being printed and discharging the printed paper to the outside of the printing machine, the printing system suspends the printing operation.

(4) Subsequently, the printing system searches for another paper feed unit to continue a printing operation and then feeds paper sheets from the other paper feed unit to continue the printing operation.

As described above, in a conventional printing system, downtime arises, in which a printing operation temporarily stops during a time period from detection of running out of paper sheets to restart of the printing operation.

SUMMARY OF THE INVENTION

Embodiments of the present invention are directed to a printing system, a job processing method, a storage medium, and a printing apparatus in which resources for printing can be effectively utilized without causing downtime to wastefully arise.

According to an aspect of the present invention, a printing system includes a receiver that receives via an user interface unit a setting for enabling a printing apparatus to perform a specific operation, the specific operation continuing a printing of a job to be processed by using second printing media of a second supply source after using first printing media of a first supply source without expending all of first printing media of the first supply source, the size and type of the second printing media being the same as the first printing media; and a controller that enables the printing apparatus to perform the specific operation in a case where the setting is received by the receiver.

According to another aspect of the present invention, a method includes receiving via an user interface unit a setting for enabling a printing apparatus to perform a specific operation, the specific operation continuing printing of a print job by using second printing media of a second supply source after using first printing media of a first supply source without expending all of first printing media of the first supply source, the size and type of the second printing media being the same as the first printing media; and enabling the printing apparatus to perform the specific operation in a case where the setting is received.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principle of the invention.

FIG. 15 illustrates an exemplary data structure of data used in a print job, which is stored in a memory area according to an exemplary embodiment of the present invention.

FIG. 20 illustrates exemplary setting information for a paper feed cassette stored in a memory area according to an exemplary embodiment of the present invention.

FIG. 23 illustrates exemplary data of paper type information stored in a memory area according to an exemplary embodiment of the present invention.

FIG. 25 illustrates exemplary data of paper feed cassette information stored in a memory area according to an exemplary embodiment of the present invention.

FIG. 26 illustrates a memory map of a storage medium (recording medium) storing various data processing programs that can be read by an information processing apparatus according to an exemplary embodiment of the present invention.

DETAILED DESCRIPTION OF THE EMBODIMENTS

Various exemplary embodiments, features and aspects of the present invention will now herein be described in detail with reference to the drawings. It is be noted that the relative arrangement of the components, the numerical expressions, and numerical values set forth in these embodiments are not intended to limit the scope of the present invention unless it is specifically stated otherwise.

An exemplary embodiment of the present invention will now be described in detail below with reference to the drawings.

Figure 1:
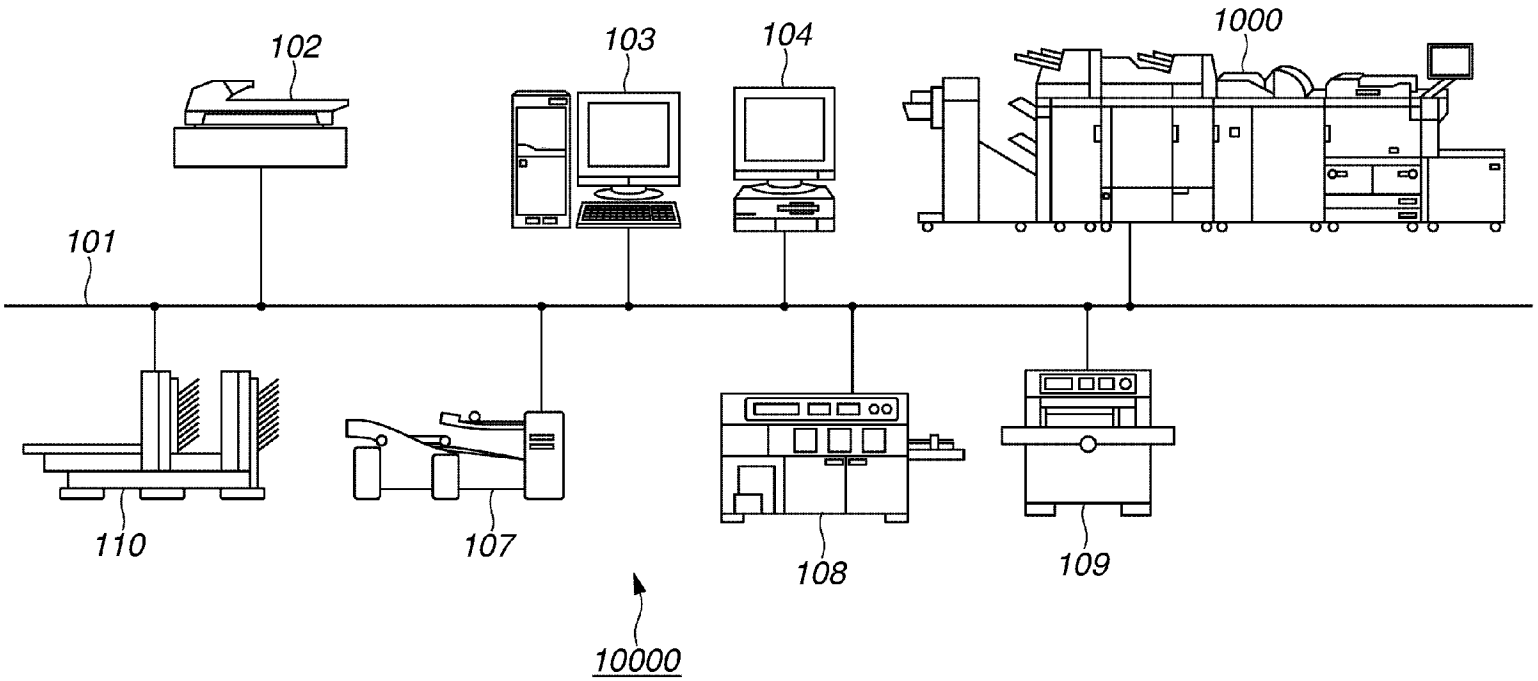
FIG. 1 illustrates an exemplary configuration of a Print On Demand (POD) system.

Referring to FIG. 1, a POD system 10000 includes a printing system 1000, a scanner 102, a server computer 103 (personal computer (PC) 103), and a client computer 104 (PC 104), which are in communication with one another via a network 101. In addition, the POD system 10000 includes a paper folding machine 107, a cutting machine 109, a saddle stitch binding machine 110, and a case binding machine 108.

Figure 2:
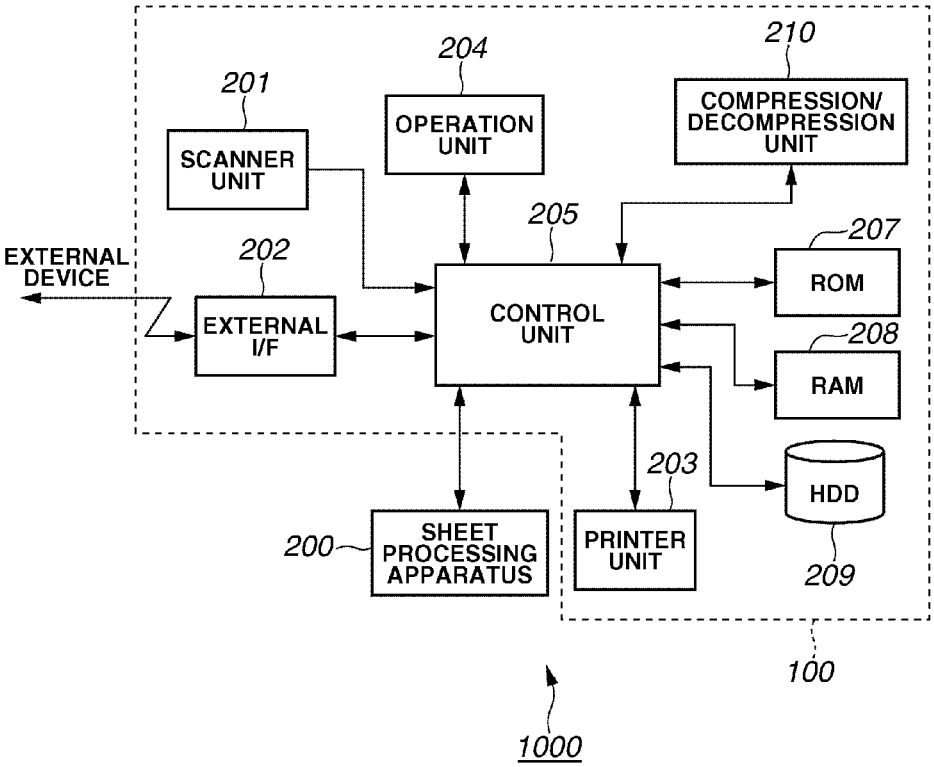
FIG. 2 illustrates an exemplary configuration of a printing system according to an exemplary embodiment of the present invention.

The printing system 1000 includes a printing apparatus 100 and a sheet processing apparatus 200 (see FIG. 2). In the present exemplary embodiment, a multifunction peripheral (MFP) having a plurality of functions, such as a copy function and a printer function, will be described as an example of the printing apparatus 100. The printing apparatus 100 can be a single function printing apparatus including a copy function only or a printer function only.

The PC 103 manages sending and receiving of data among various apparatuses in communication with one another via the network 101. The PC 104 sends image data to the printing apparatus 100 and the PC 103 via the network 101. The paper folding machine 107 folds paper sheets printed with the printing apparatus 100. The case binding machine 108 performs case binding processing of sheets printed with the printing apparatus 100. The cutting machine 109 cuts a stack of sheets printed with the printing apparatus 100. The saddle stitch binding machine 110 performs saddle stitch binding processing on sheets printed with the printing apparatus 100.

In utilizing the paper folding machine 107, the case binding machine 108, the cutting machine 109, and the saddle stitch binding machine 110, a user (operator) takes out sheets printed with the printing apparatus 100 from the printing system 1000 and then sets the printed sheets onto the machine that the user desires to use to perform desired processing. Among a plurality of apparatuses included in the POD system 10000 illustrated in FIG. 1, the apparatuses other than the saddle stitch binding machine 110 are in communication with one another via the network 101 to perform data communication with one another.

An exemplary configuration of the printing system 1000 will now be described below with reference to a system block diagram illustrated in FIG. 2.

Units other than the sheet processing apparatus 200 of units included in the printing system 1000 illustrated in FIG. 2 are included in the printing apparatus 100. An arbitrary number of sheet processing apparatuses 200 can be connected to the printing apparatus 100.

The printing system 1000 can perform sheet processing of sheets printed with the printing apparatus 100, via the sheet processing apparatus 200, which is in communication with the printing apparatus 100. The printing system 1000 can include only the printing apparatus 100 without connecting the sheet processing apparatus 200 to the printing apparatus 100.

The sheet processing apparatus 200 can communicate with the printing apparatus 100. The sheet processing apparatus 200 receives an instruction from the printing apparatus 100 to perform sheet processing to be described later below. A scanner unit 201 reads an image on an original document, converts the read image into image data, and transfers the converted image data to another unit. An external interface (I/F) unit 202 sends and receives data to and from another apparatus that is in communication with the external I/F unit 202 via the network 101.

A printer unit 203 prints an image on a sheet according to input image data. An operation unit 204 includes a hard key input unit 402 (FIG. 7) and a touch panel 401 (FIG. 7) and receives an instruction from the user via the hard key input unit 402 and the touch panel 401. The operation unit 204 performs various displays on the touch panel 401.

A control unit 205 controls processing and operations of the various units included in the printing system 1000. That is, the control unit 205 controls the operations of the printing apparatus 100 and the sheet processing apparatus 200 connected to the printing apparatus 100.

A read-only memory (ROM) 207 stores various programs to be executed by the control unit 205. For example, the ROM 207 stores a program used for executing various processing illustrated in flow charts to be described later below and a display control program used for displaying various setting screens to be described later below.

In addition, the ROM 207 stores a program used for allowing the control unit 205 to interpret page description language (PDL) code data received from the PC 103 or the PC 104 and to rasterize the interpreted data into raster image data. Furthermore, the ROM 207 stores various programs, such as a boot sequence and a program for font information.

A random access memory (RAM) 208 stores image data sent from the scanner unit 201 or the external I/F unit 202 and various programs and setting information stored in the ROM 207. Furthermore, the RAM 208 stores information related to the sheet processing apparatus 200 (information on the number of sheet processing apparatuses 200 connected to the printing apparatus 100 (from 0 to n), information on functions of each of the sheet processing apparatuses 200, and information on a connection order of the sheet processing apparatuses 200).

A hard disk drive (HDD) 209 includes a hard disk and a drive unit used for reading and writing data from and onto the hard disk. The HDD 209 is a large-capacity storage device storing image data input from the scanner unit 201 or the external I/F unit 202 and compressed by a compression/decompression unit 210.

The control unit 205 can perform printing of the image data stored in the HDD 209 with the printer unit 203 according to an instruction from the user. Moreover, the control unit 205 can send image data stored in the HDD 209 to an external apparatus, such as the PC 103, via the external I/F unit 202 according to an instruction from the user.

The compression/decompression unit 210 performs an operation for compressing and decompressing image data stored in the RAM 208 or the HDD 209 according to various compression systems, such as Joint Bi-level Image Experts Group (JBIG) and Joint Photographic Experts Group (JPEG).

Figure 3:
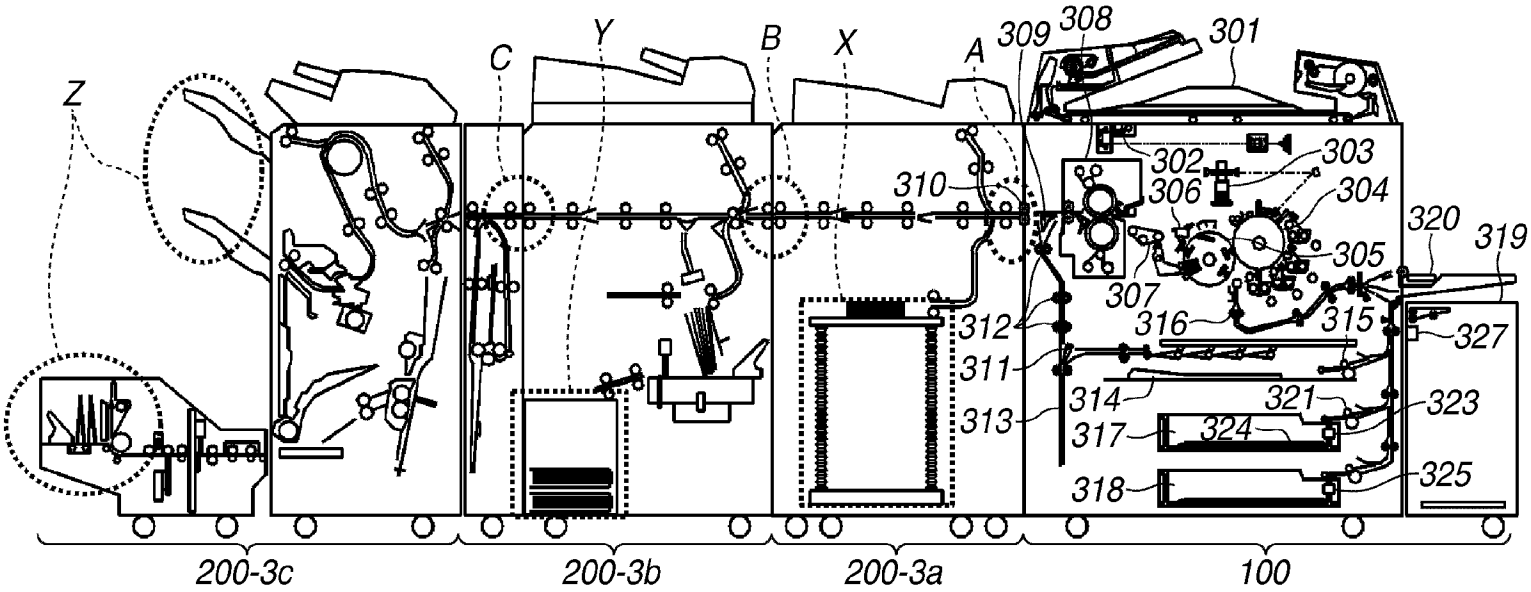
FIG. 3 illustrates an exemplary configuration of a printing system according to an exemplary embodiment of the present invention.

An exemplary configuration of the printing system 1000 will now be described with reference to FIG. 3. FIG. 3 is a cross section of the printing apparatus 100 and the sheet processing apparatus 200 connected to the printing apparatus 100.

An auto document conveyance apparatus (auto document feeder (ADF)) 301 separates a document placed on top of a document bundle set on a stacking surface of a document tray in a stacking order and conveys the separated document onto a document positioning glass to scan the document with a scanner 302.

The scanner 302 reads an image on the document conveyed onto the document positioning glass and converts the read image into image data with a charge-coupled device (CCD). A ray, such as a laser beam, modulated according to image data is made incident on a rotating polygonal mirror 303. The ray reflected from the polygon mirror 303 falls on the surface of a photosensitive drum 304 via a reflection mirror as reflection scanning light.

A latent image formed on the surface of the photosensitive drum 304 with the laser beam is developed with a toner. A toner image is transferred onto a sheet attached onto the surface of a transfer drum 305. By serially performing a series of image forming processing on toners of colors of yellow (Y), magenta (M), cyan (C), and black (K), a full color image is formed. After performing four image forming processing, a sheet on the transfer drum 305, onto which a full color image has been formed, is separated by a separation claw 306. The separated sheet is conveyed to a fixing device 308 by a pre-fixing conveyance device 307.

The fixing device 308 includes rollers and a belt in combination with one another. The fixing device 308 includes therein a heat source, such as a halogen heater, and resolves and fixes the toner on the sheet, onto which the toner image has been transferred, with heat and pressure. A paper discharge flapper 309 can swing around a swinging axis and regulates the direction of conveying a sheet.

When the paper discharge flapper 309 swings clockwise in FIG. 3, a sheet is conveyed in a straight direction and then is discharged to the outside of the printing apparatus 100 by a discharge roller 310. With a series of processing described above, the control unit 205 controls the printing apparatus 100 so that the printing apparatus 100 performs one-sided printing.

In forming images on both sides of a sheet, the paper discharge flapper 309 swings counterclockwise in FIG. 3. The conveyance direction of the sheet is changed to a downward direction to convey the sheet to a two-sided conveyance unit. The two-sided conveyance unit includes a reversal flapper 311, a reversal roller 312, a reversal guide 313, and a two-sided tray 314.

The reversal flapper 311 swings around a swinging axis and regulates the direction of conveying a sheet. In performing a two-sided print job, the control unit 205 performs control so that the reversal flapper 311 swings counterclockwise in FIG. 3 to convey a sheet, whose first side is already printed with the printer unit 203, into the reversal guide 313 via the reversal roller 312. The control unit 205 temporarily stops the reversal roller 312 in the state where a trailing edge of the sheet is pinched by the reversal roller 312, and then allows the reversal flapper 311 to swing clockwise in FIG. 3. Further, the control unit 205 allows the reversal roller 312 to rotate in a reverse direction.

Thus, the sheet is switched back to be conveyed. The control unit 205 performs control to guide the sheet to the two-sided tray 314 in the state where the leading edge and the trailing edge of the sheet have been changed in position. The sheet is temporarily stacked on the two-sided tray 314. The sheet is then conveyed to a registration roller 316 by a refeed roller 315.

At this time, the sheet is fed with a side thereof opposite to the first side used in the transfer processing facing the photosensitive drum 304. Then, the control unit 205 performs control to form an image on the second side of the sheet as in the processing described above. Thus, images are formed on both sides of the sheet. After fixing processing is completed, the sheet is discharged to the outside of the printing apparatus 100 via the discharge roller 310.

By serially performing the processing described above, the control unit 205 controls the printing apparatus 100 to perform two-sided printing.

In addition, the printing apparatus 100 includes a paper feed unit for storing sheets used for print processing. The paper feed unit includes paper feed cassettes 317 and 318, each of which can store, for example, five hundred sheets, a paper feed deck 319, which can store, for example, five thousand sheets, and a manual feed tray 320.

Various sheets of different sizes and materials can be respectively set in the paper feed cassettes 317 and 318 and the paper feed deck 319. In the manual feed tray 320, various types of sheets including a special sheet, such as an overhead projector (OHP) sheet, can be set. Each of the paper feed cassettes 317 and 318, the paper feed deck 319, and the manual feed tray 320 includes a paper feed roller. Sheets can be serially fed one by one by the paper feed roller.

The sheet processing apparatus 200 illustrated in FIG. 3 will now be described.

An arbitrary number of different types of sheet processing apparatuses 200 in the printing system 1000 according to the present exemplary embodiment can be connected in tandem as long as sheets can be conveyed from the sheet processing apparatus 200 on the upstream side to the sheet processing apparatus 200 on the downstream side via a sheet conveyance path. For example, as illustrated in FIG. 3, the sheet processing apparatuses 200 can include a large-capacity stacker 200-3*a*, a gluing bookbinding machine 200-3*b*, and a saddle stitch binding machine 200-3*c* in this order from the printing apparatus 100. The large-capacity stacker 200-3*a*, the gluing bookbinding machine 200-3*b*, and the saddle stitch binding machine 200-3*c* can be selectively used by the printing system 1000.

Each of the sheet processing apparatuses 200 includes a sheet discharge unit. The user can take out the sheet that has been subjected to sheet processing from the sheet discharge unit of each of the sheet processing apparatuses 200.

The control unit 205 receives a request for performing sheet processing desired by the user of a plurality of types of sheet processing options that can be performed by the sheet processing apparatus 200 connected with the printing apparatus 100, together with a request for performing printing, via the operation unit 204. When the control unit 205 receives the request for performing printing of a job to be processed from the user via the operation unit 204, the control unit 205 performs the print processing requested for the job with the printer unit 203.

The control unit 205 allows the sheet for the job on which the print processing has been performed to be conveyed to the sheet processing apparatus 200 that can perform the sheet processing desired by the user via the sheet conveyance path and to perform the sheet processing with the sheet processing apparatus 200.

For example, in the case of the printing system 1000 having the system configuration illustrated in FIG. 3, suppose that a job to be processed whose request for printing has been received from the user is a job that has been instructed to be subjected to large amount stacking processing with the large-capacity stacker 200-3*a*. That job is herein referred to as a "stacker job".

In the case where the stacker job is processed with the system configuration illustrated in FIG. 3, the control unit 205 allows the sheet in the job that has been printed with the printing apparatus 100 to pass a point A in FIG. 3 and to be conveyed into the large-capacity stacker 200-3*a*. After that, the control unit 205 performs the stacking processing in the job with the large-capacity stacker 200-3*a*.

Then, the control unit 205 allows the print product of the job on which the stacking processing has been performed with the large-capacity stacker 200-3*a* to be held in a paper discharge destination X in the large-capacity stacker 200-3*a*, without conveying the print product to another apparatus (for example, an apparatus in a later stage).

The user can take out the print product of the stacker job that is held in the paper discharge destination X in FIG. 3 directly from the paper discharge destination X. Accordingly, a series of operations of the apparatuses and the user's operation including conveyance of the sheet to a paper discharge destination Z at the most downstream position in the sheet conveyance direction in FIG. 3 and taking out of the print product of the stacker job from the paper discharge destination Z become unnecessary.

In addition, suppose that the job to be processed whose request for printing has been received from the user in the system configuration in FIG. 3 is a job that has been instructed to be subjected to sheet processing (for example, gluing bookbinding processing, such as case binding processing or top gluing binding) with the gluing bookbinding machine 200-3*b*. That job is herein referred to as a "gluing bookbinding job".

In performing the gluing bookbinding job with the system configuration illustrated in FIG. 3, the control unit 205 allows a sheet printed with the printing apparatus 100 to be conveyed into the inside of the gluing bookbinding machine 200-3*b* via points A and B in FIG. 3. After that, the control unit 205 performs the gluing bookbinding processing of the job with the gluing bookbinding machine 200-3*b*.

Then, the control unit 205 allows the print product of the job on which the gluing bookbinding processing has been performed with the gluing bookbinding machine 200-3*b* to be held in a paper discharge destination Y in the gluing bookbinding machine 200-3*b*, without conveying the print product to another apparatus (for example, an apparatus in a later stage).

Furthermore, for example, in the case of the system configuration illustrated in FIG. 3, suppose that a job to be processed whose request for printing has been received from the user is a job that has been instructed to be subjected to sheet processing with the saddle stitch binding machine 200-3*c*. The sheet processing performed with the saddle stitch binding machine 200-3*c* includes, for example, saddle stitch binding processing, punching processing, cutting processing, shift discharge processing, and folding processing. That job is herein referred to as a "saddle stitch binding job".

In the case of processing the saddle stitch binding job with the system configuration in FIG. 3, the control unit 205 allows a sheet used in the job printed with the printing apparatus 100 to pass points A, B, and C in FIG. 3 to be conveyed to the saddle stitch binding machine 200-3*c*. After that, the control unit 205 performs the sheet processing of the job with the saddle stitch binding machine 200-3*c*.

Then, the control unit 205 allows the print product of the saddle stitch binding job that has been subjected to the sheet processing with the saddle stitch binding machine 200-3*c* to be held in the paper discharge destination Z in the saddle stitch binding machine 200-3*c*.

The paper discharge destination Z includes a plurality of paper discharge destination options. With the plurality of paper discharge destination options, the saddle stitch binding machine 200-3*c* can perform a plurality of types of sheet processing. The plurality of paper discharge destination options is used for respective types of sheet processing.

As described with reference to FIGS. 1 through 3, in the printing system 1000 according to an exemplary embodiment, a plurality of sheet processing apparatuses 200 can be connected to the printing apparatus 100. The plurality of sheet processing apparatuses 200 can be connected to the printing apparatus 100 in an arbitrary combination thereof.

The order of connection of the plurality of sheet processing apparatuses 200 can be freely changed as long as the sheet conveyance path among the sheet processing apparatuses 200 can be continuously provided. Furthermore, a plurality of different types of sheet processing apparatuses 200 can be connected to the printing apparatus 100.

Figure 4:
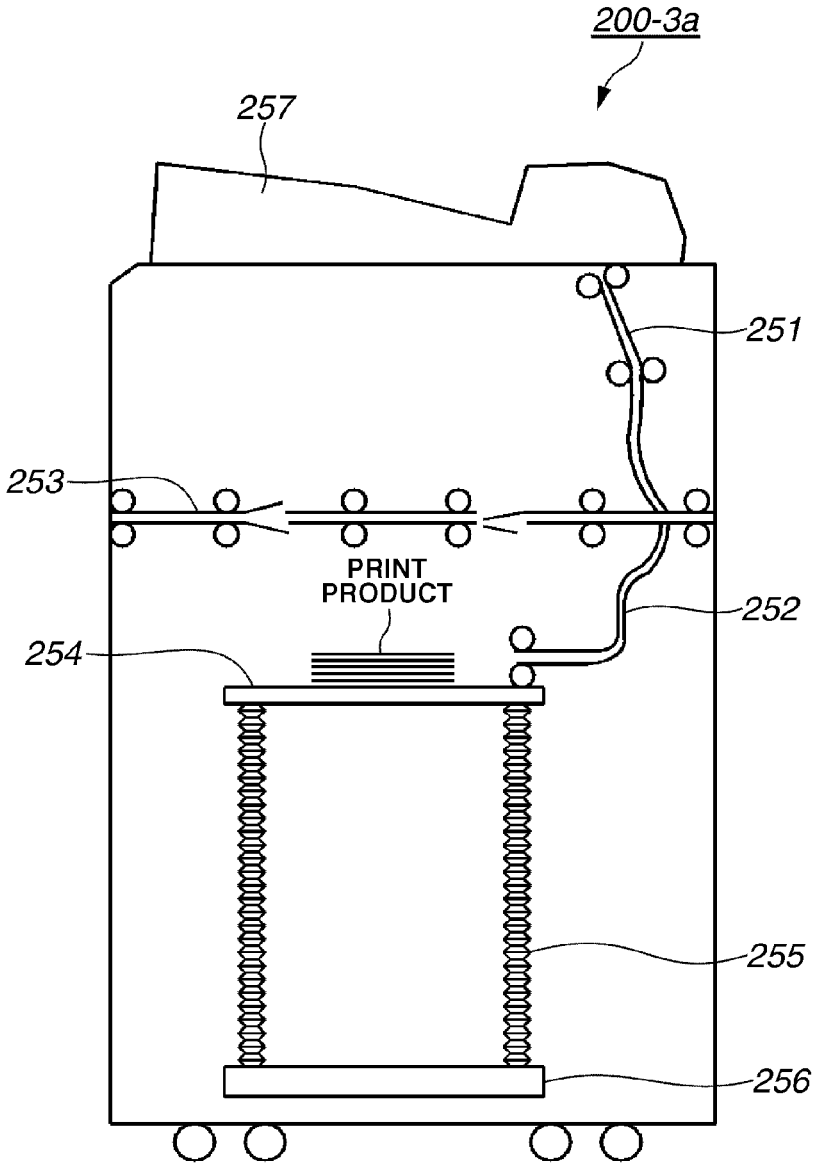
FIG. 4 illustrates an exemplary configuration of a large-capacity stacker according to an exemplary embodiment of the present invention.
Figure 5:
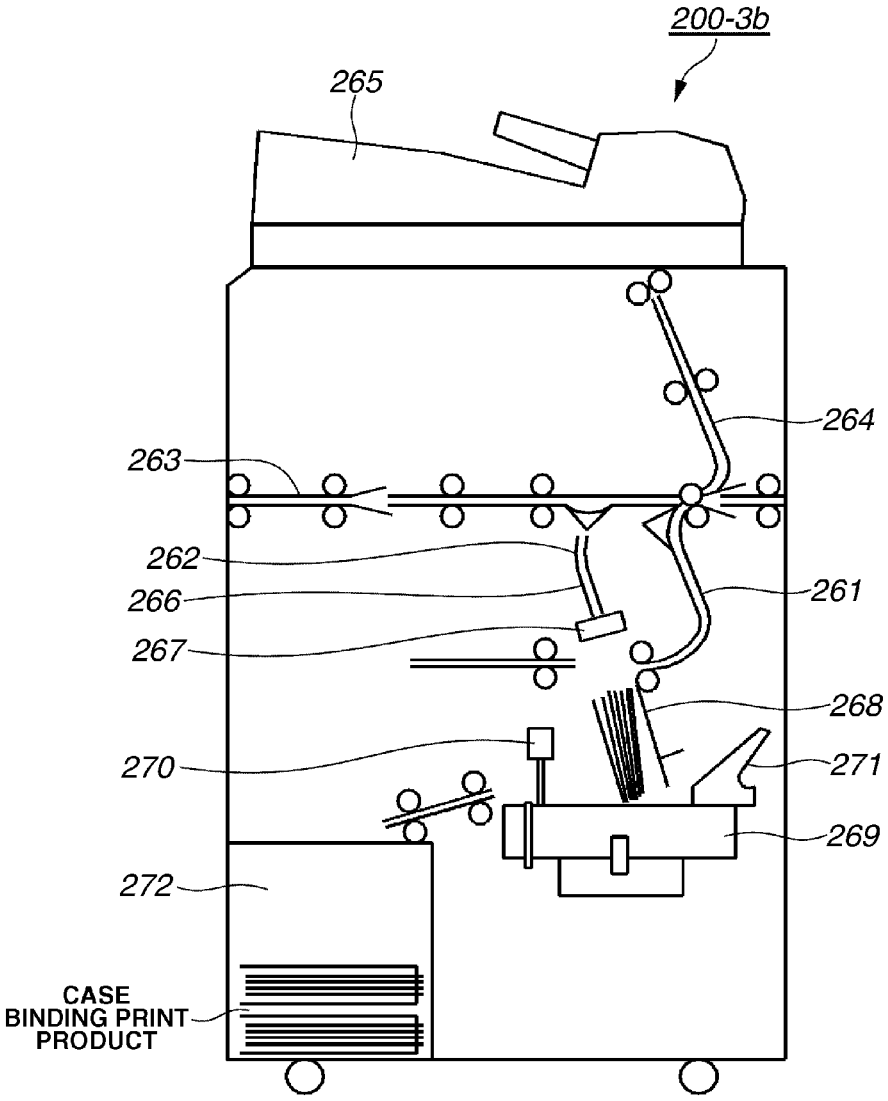
FIG. 5 illustrates an exemplary configuration of a gluing bookbinding machine according to an exemplary embodiment of the present invention.

An exemplary inner configuration of the sheet processing apparatus 200 that can be connected to the printing apparatus 100 will now be described below for each type of the sheet processing apparatus 200 with reference to FIGS. 4 to 6.

First, an exemplary inner configuration of the large-capacity stacker 200-3*a* will be described with reference to the cross section in FIG. 4. The large-capacity stacker 200-3*a* conveys a sheet conveyed from the upstream apparatus selectively to three conveyance paths. The three conveyance paths include a sample tray path 251, a stack path 252, and a straight path 253.

The stack path 252, which is included in the large-capacity stacker 200-3*a*, is used for conveying the sheet to a stack tray 254. The stack tray 254 is a stacking unit placed on an extendable stay 255.

Below the extendable stay 255, a detachable cart 256 is provided. Using the cart 256, a user can carry the sheets stacked on the stack tray 254.

Suppose that a request for performing a job on which sheet stacking processing is set to be performed with the large-capacity stacker 200-3*a* is received from the user via the operation unit 204. In this case, the control unit 205 conveys the sheet printed with the printing apparatus 100 to the stack path 252, which is included in the large-capacity stacker 200-3*a*, and discharges the sheet onto the stack tray 254 via the stack path 252.

The straight path 253 of the large-capacity stacker 200-3*a* is a sheet conveyance path used for conveying the sheet used in the job that requires no sheet stacking processing with the stack tray 254 to an apparatus in a later stage.

The sample tray path 251 is a sheet conveyance path used for discharging the sheet onto a sample tray 257. These components are used in simplifying taking out of an output from the stack tray 254 during an operation that requires confirmation of an output. In this case, the control unit 205 conveys the sheet printed with the printing apparatus 100 to the sample tray path 251 and discharges the sheet onto the sample tray 257 via the sample tray path 251.

In the sheet conveyance path in the large-capacity stacker 200-3*a*, a plurality of sheet detection sensors (not shown) used for detecting the state of sheet conveyance and the occurrence of jamming are provided.

In addition, the large-capacity stacker 200-3*a* includes a central processing unit (not shown). The CPU notifies information about sheet detection from each sensor to the control unit 205 via a signal line used for performing data communication. The control unit 205, according to the information from the large-capacity stacker 200-3*a*, can recognize the state of sheet conveyance and the occurrence of jamming in the large-capacity stacker 200-3*a*.

In a case where another sheet processing apparatus is connected between the large-capacity stacker 200-3*a* and the printing apparatus 100, a CPU included in that sheet processing apparatus 200 notifies the information from the sensor of the large-capacity stacker 200-3*a* to the control unit 205.

An exemplary inner configuration of the gluing bookbinding machine 200-3*b* will now be described below with reference to the cross section in FIG. 5.

The gluing bookbinding machine 200-3*b* conveys a sheet conveyed from an upstream apparatus selectively into three conveyance paths. The conveyance paths include a cover path 261, a textblock path 262, and a straight path 263.

In addition, the gluing bookbinding machine 200-3*b* includes an inserter path 264. The inserter path 264 is a sheet conveyance path used for conveying a sheet placed on an inserter tray 265 to the cover path 261.

The straight path 263 of the gluing bookbinding machine 200-3*b* is a sheet conveyance path used for conveying a sheet used in a job that requires no gluing bookbinding processing with the gluing bookbinding machine 200-3*b* to a later stage apparatus.

The textblock path 262 and the cover path 261 of the gluing bookbinding machine 200-3*b* are sheet conveyance paths used for conveying a sheet necessary for generating a case binding print product.

For example, in generating a case binding print product using the gluing bookbinding machine 200-3*b*, the control unit 205 prints image data for the text that is to be printed on a sheet for the text of the case binding print product with the printer unit 203. In generating one case binding print product, a sheet stack for one book including sheets for the text is wrapped with one cover sheet. The sheet stack for the text used in case binding is herein referred to as a "textblock".

The control unit 205 performs control so that the sheets for the textblock printed with the printing apparatus 100 are conveyed to the textblock path 262.

The control unit 205, in performing case binding processing, performs processing for binding the textblock sheets printed with the printing apparatus 100 with the cover sheet conveyed via the cover path 261.

For example, the control unit 205 allows the textblock sheets conveyed from an upstream apparatus to be serially stacked in a stacking unit 266 via the textblock path 262. When the sheets onto which the text data is printed are stacked in the stacking unit 266 in an amount equivalent to the number of sheets for one book, the control unit 205 allows one sheet used for the cover required in the job to be conveyed via the cover path 261.

The control unit 205 controls a gluing unit 267 so that the gluing unit 267 performs gluing processing on a spine portion of one set of the sheet stack that is equivalent to the textblock. After that, the control unit 205 controls the gluing unit 267 so that the gluing unit 267 attaches the spine portion of the textblock to a central portion of the cover sheet. In attaching the textblock to the cover, the textblock is conveyed while being pressed into a lower portion of the gluing bookbinding machine 200-3*b*.

Thus, the control unit 205 performs processing for folding the cover sheet to wrap the textblock with one cover sheet. Subsequently, one set of sheet stack is stacked on a turntable 269 along a guide 268.

After one set of sheet stack is set on the turntable 269, the control unit 205 performs processing for cutting the sheet stack with a cutter unit 270. In performing the cutting processing, three-side trimming processing, in which three sides except for the edge corresponding to the spine portion of one set of the sheet stack are cut, is performed with the cutter unit 270.

Subsequently, the control unit 205 presses the sheet stack that has been trimmed in three sides toward a basket 272 using a narrowing portion 271 to store the sheet stack in the basket 272.

An exemplary inner configuration of the saddle stitch binding machine 200-3*c* will now be described below with reference to the cross section in FIG. 6.

The saddle stitch binding machine 200-3*c* includes various units provided for selectively performing stapling processing, cutting processing, punching processing, folding processing, shift discharge processing, and saddle stitch binding processing on a sheet from the printing apparatus 100.

Furthermore, the saddle stitch binding machine 200-3*c* does not include a straight path that functions as a sheet conveyance path to a downstream apparatus. Accordingly, in connecting a plurality of sheet processing apparatuses 200 to the printing apparatus 100, the saddle stitch binding machine 200-3*c* is connected as the last apparatus, as illustrated in FIG. 3.

Figure 6:
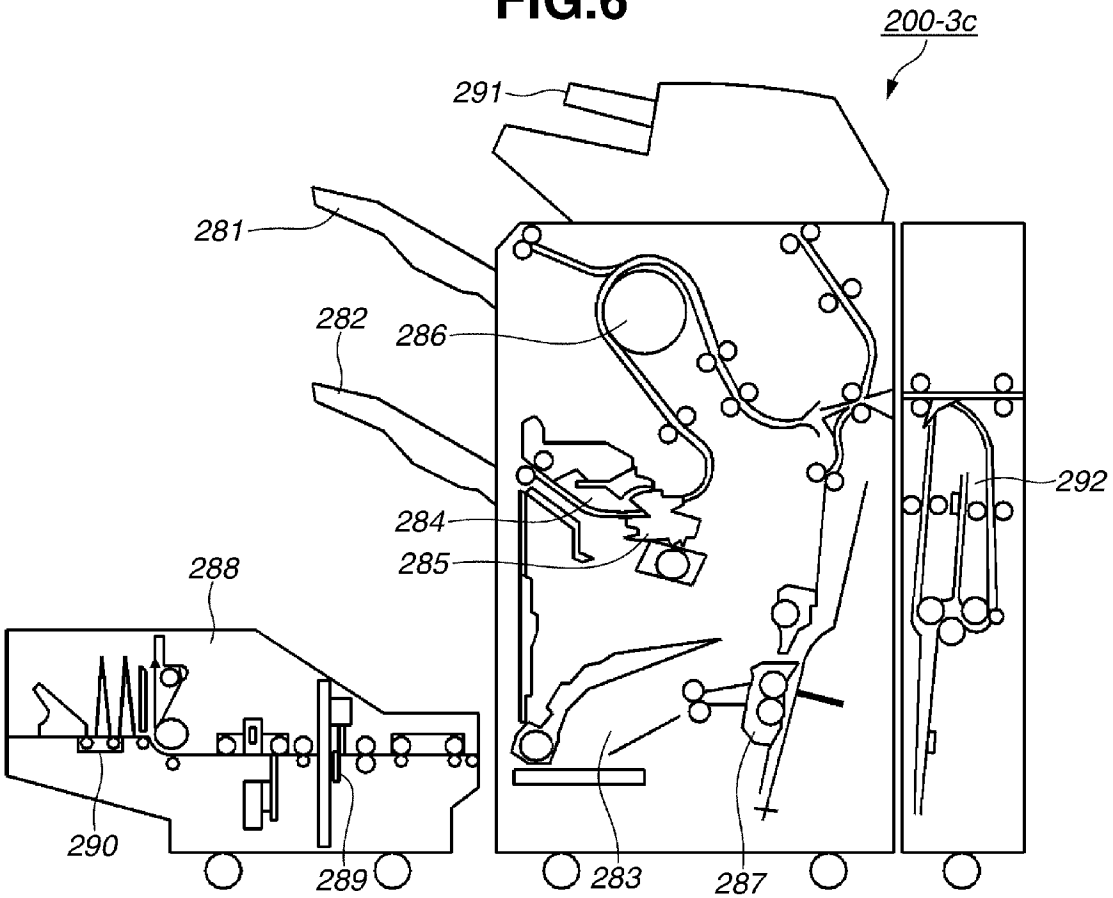
FIG. 6 illustrates an exemplary configuration of a saddle stitch binding machine according to an exemplary embodiment of the present invention.

In addition, the saddle stitch binding machine 200-3*c* includes a sample tray 281 and a stack tray 282 outside the saddle stitch binding machine 200-3*c* and a booklet tray 283 inside the saddle stitch binding machine 200-3*c*, as illustrated in FIG. 6.

When the control unit 205 receives an instruction for stapling with the saddle stitch binding machine 200-3*c*, the control unit 205 allows sheets printed with the printing apparatus 100 to be serially stacked into a processing tray 284 inside the saddle stitch binding machine 200-3*c*. After the sheets for one sheet stack are stacked on the processing tray 284, the control unit 205 performs stapling with a stapler 285. Then, the control unit 205 discharges the stapled sheet stack from the processing tray 284 to the stack tray 282.

In performing a job in which Z-folding is instructed to be performed with the saddle stitch binding machine 200-3*c*, the control unit 205 performs processing for folding the sheet printed with the printing apparatus 100 in a Z-like shape with a Z-folding unit 292. Then, the control unit 205 allows the folded sheet to pass through the saddle stitch binding machine 200-3*c* and to be discharged onto a discharge tray, such as the stack tray 282 or the sample tray 281.

When the control unit 205 is instructed to perform punching processing with the saddle stitch binding machine 200-3*c*, the control unit 205 performs punching processing on the sheet printed with the printing apparatus 100 with a puncher unit 286. Then, the control unit 205 allows the sheet to pass through the saddle stitch binding machine 200-3*c* and to be discharged onto a discharge tray, such as the stack tray 282 or the sample tray 281.

In performing a job in which saddle stitch binding is instructed to be performed with the saddle stitch binding machine 200-3*c*, the control unit 205 performs binding at two positions in a central portion of the sheet stack including a plurality of sheets for one set with a saddle stitcher unit 287. After that, the control unit 205 performs two-folding using the central portion of the sheet stack as a reference by engaging the central portion of the sheet stack with a roller.

Thus, a leaflet-like booklet can be produced. The sheet stack on which the saddle stitch binding processing has been performed with the saddle stitcher unit 287 is conveyed to the booklet tray 283.

When the control unit 205 receives an instruction for performing cutting processing on the job in which saddle stitch binding processing is instructed to be performed, the control unit 205 conveys the saddle stitch-bound sheet stack from the booklet tray 283 to a trimmer 288. Subsequently, the control unit 205 cuts the sheet stack conveyed to the trimmer 288 with a cutter unit 289 and stores the sheet stack in a booklet holding unit 290. The saddle stitch binding machine 200-3*c* can also perform the three-side trimming of the saddle stitch-bound sheet stack.

When the saddle stitch binding machine 200-3*c* does not include a trimmer, the sheet stack bound with the saddle stitcher unit 287 can be taken out of the booklet tray 283.

Furthermore, the saddle stitch binding machine 200-3*c* can add a sheet set on an insertion tray 291 (for example, a previously printed cover sheet) to the sheet printed with and conveyed from the printing apparatus 100.

An exemplary configuration of the operation unit 204 will now be described below with reference to FIG. 7.

The operation unit 204 includes a touch panel 401 and a key input unit 402. The touch panel 401 includes a liquid crystal display (LCD) and a transparent electrode attached on the LCD, and displays various setting screens used for receiving an instruction from the user. The touch panel 401 not only functions to display various setting screens but also functions to input an instruction to receive an instruction from the user.

The key input unit 402 includes a power key 501, a start key 503, a stop key 502, a reset key 504, a user mode key 505, a numeral keypad 506, and a clear key 507. The start key 503 is used for starting a copy job or a sending job with the printing apparatus 100. The numeral keypad 506 is used in performing a setting for entering numerical values, such as the number of copies to print. The clear key 507 is used for clearing various parameters set by using the numeral keypad 506.

The control unit 205 controls the printing system 1000 so that the printing system 1000 performs various processing according to a user instruction received via various screens displayed on the touch panel 401 and a user instruction received via the key input unit 402.

Figure 7:
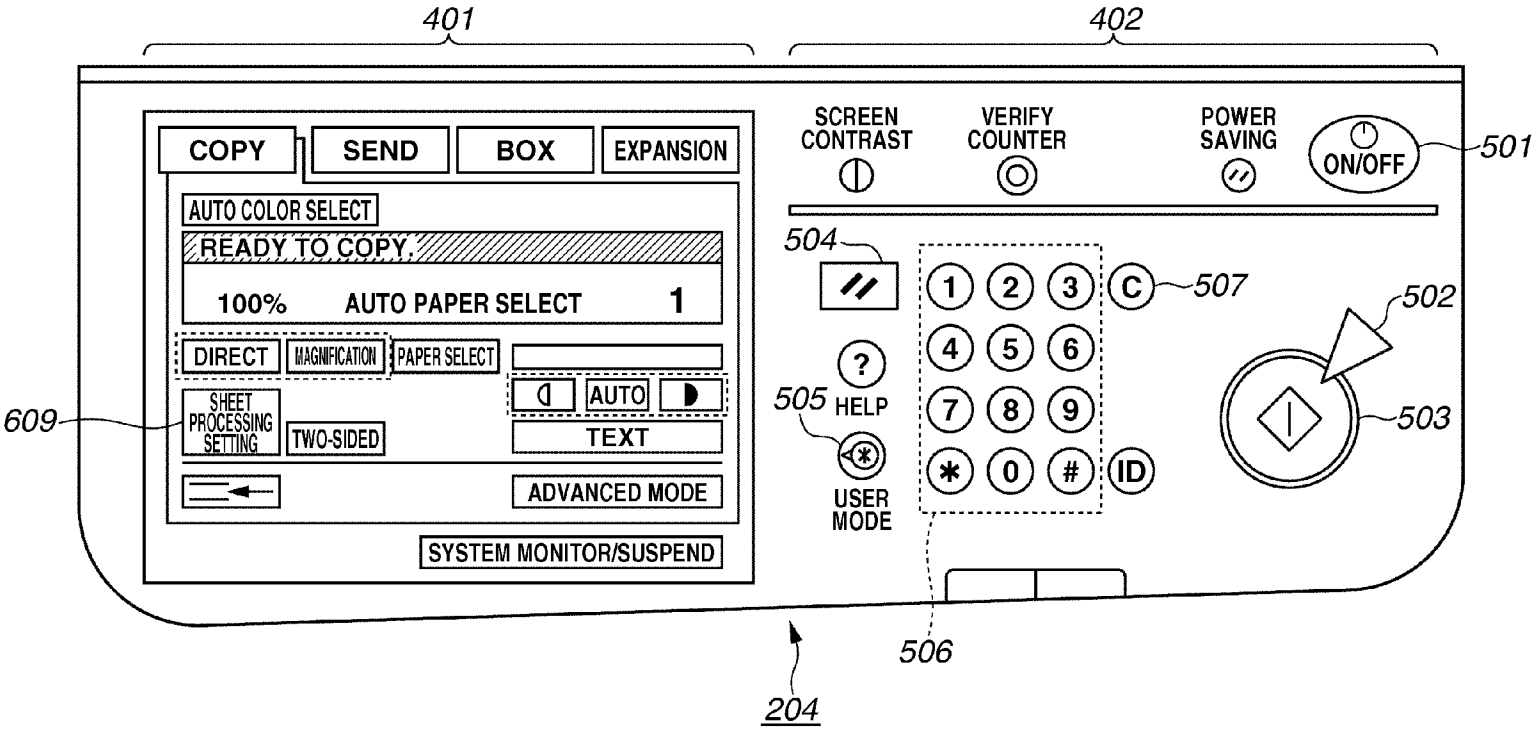
FIG. 7 illustrates an example of a user interface unit according to an exemplary embodiment of the present invention.
Figure 8:
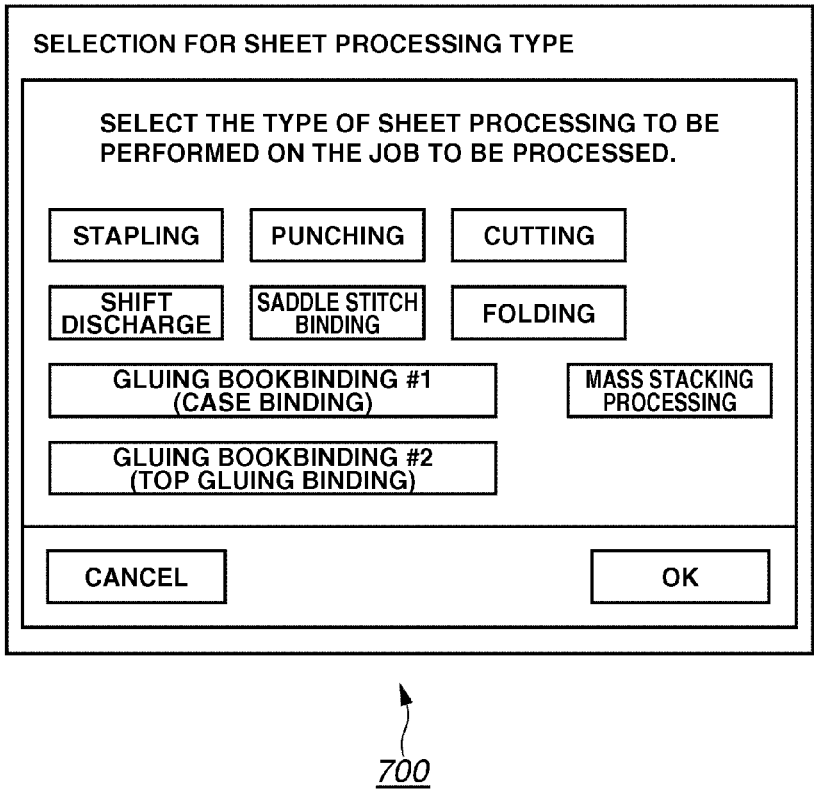
FIGS. 8 through 10 each illustrate an example of a user interface screen according to an exemplary embodiment of the present invention.

FIG. 8 illustrates a setting screen 700 used for allowing the user to select a type of sheet processing performed on a sheet printed with the printing apparatus 100. The control unit 205, when a sheet processing setting key 609 (FIG. 7) in the screen displayed on the touch panel 401 is pressed by the user, displays the setting screen 700 illustrated in FIG. 8 on the touch panel 401.

The setting screen 700 illustrated in FIG. 8 is a setting screen configured so that the user can select a type of sheet processing that can be performed with the sheet processing apparatus 200 in the printing system 1000. The control unit 205 receives the settings for the sheet processing to be performed during a job to be processed via the setting screen 700 in FIG. 8, and performs the sheet processing with the sheet processing apparatus 200 according to the received settings.

Figure 9:
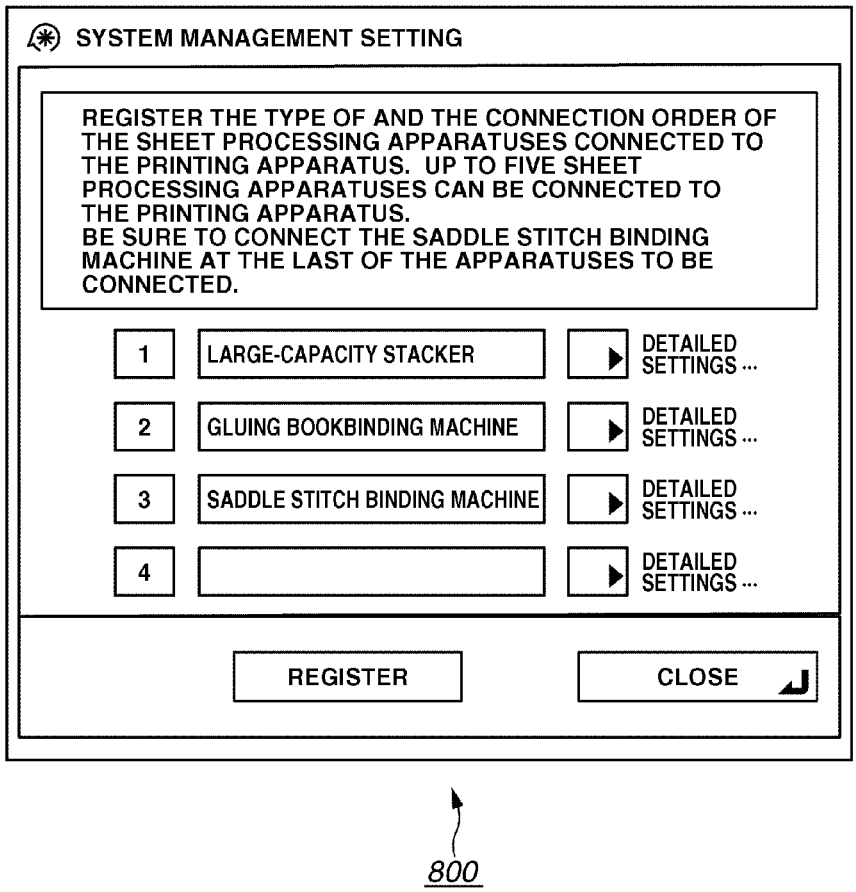

A setting screen 800 illustrated in FIG. 9 is configured so that in a case where the sheet processing apparatus 200 is connected to the printing apparatus 100, the user can register information for performing a designation as to the types, number, and order of sheet processing apparatuses 200 connected to the printing apparatus 100. When the user presses the user mode key 505 (FIG. 7), the control unit 205 performs control so that the setting screen 800 illustrated in FIG. 9 can be displayed on the touch panel 401.

For example, in a case where the printing system 1000 has the system configuration illustrated in FIG. 3, the user sets via the setting screen 800 registration information indicating that three sheet processing apparatuses 200, namely, the large-capacity stacker 200-3*a*, the gluing bookbinding machine 200-3*b*, and the saddle stitch binding machine 200-3*c*, are connected to the printing apparatus 100 in this order. The control unit 205 stores the information related to the sheet processing apparatus 200 set by the user via the setting screen 800 in the RAM 208 as system configuration information, and reads and refers to the stored information as necessary. Thus, the control unit 205 verifies the type of sheet processing that can be performed by the sheet processing apparatuses 200 and what number of sheet processing apparatuses 200 are connected to the printing apparatus 100 in what order.

Suppose that the user has performed a setting via the setting screen 800 in FIG. 9 so that a saddle stitch binding machine having no straight path is connected at some midpoint of the combination of a plurality of sheet processing apparatuses. In this case, the control unit 205 disables the setting and displays an error message on the touch panel 401. In addition, as illustrated in FIG. 9, the control unit 205 displays guidance information for making a notification for prompting the user to connect the saddle stitch binding machine at the last of tandem of the sheet processing apparatuses 200 without performing such setting.

In the present exemplary embodiment, the operation unit 204 included in the printing apparatus 100 is described as an example of a user interface unit applied in the printing system 1000. However, the configuration is not limited to this. For example, the printing system 1000 can perform the processing according to an instruction generated via the user interface unit included in an external apparatus, such as the PC 103 or the PC 104.

Figure 10:
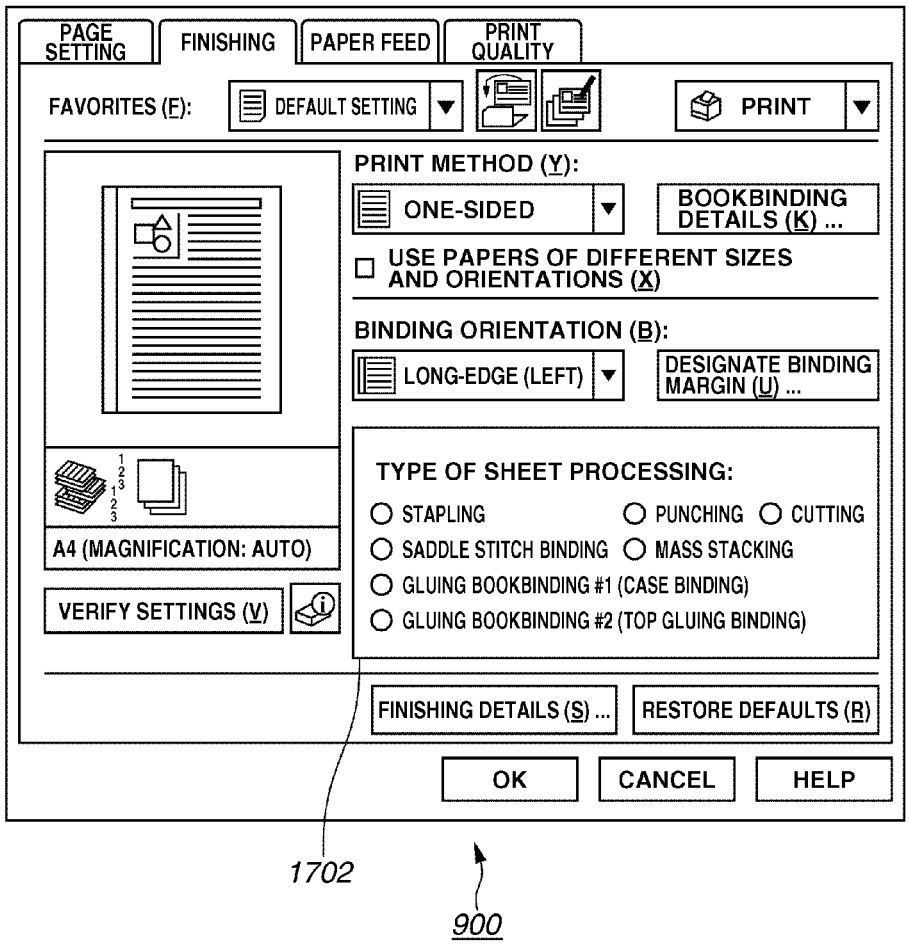

In remotely operating the printing system 1000 from an external apparatus, a setting screen 900 related to the printing system 1000 illustrated in FIG. 10 is displayed on a display unit of the external apparatus. A description thereof will now be made below using the PC 104 as an example. FIG. 10 illustrates an example of the setting screen 900 displayed on a display of the PC 104.

A CPU included in the PC 104, when the CPU receives a print request from the user, displays the setting screen 900 illustrated in FIG. 10 on the display of the PC 104, and then receives settings for the print processing condition from the user of the PC 104 via the setting screen 900. For example, the CPU of the PC 104 receives from the user the type of the sheet processing to be performed by the sheet processing apparatus 200 for a print job that is requested from the PC 104, via a setting field 1702.

When a request for performing printing is received upon pressing of an OK key in FIG. 10, the CPU of the PC 104 performs control so that the print processing condition received via the setting screen 900 and the image data to be printed are linked with each other and are sent to the printing system 1000 via the network 101. Meanwhile, in the printing system 1000, when the control unit 205 receives a request for performing printing of a job via the external I/F unit 202, the control unit 205 controls the printing system 1000 so that the printing system 1000 processes the job from the PC 104 according to the print processing condition from the PC 104.

As described above, various units are provided as the user interface of the printing system 1000.

The printing system 1000 includes the printing apparatus 100. The printing apparatus 100 includes the printer unit 203. The printer unit 203 can perform print processing of data stored in the HDD 209, which can store data for a plurality of jobs. In addition, the printing system 1000 is configured so that a plurality of sheet processing apparatuses 200 can be connected to the printing apparatus 100.

Each of the plurality of sheet processing apparatuses 200, which can be connected to the printing apparatus 100, can perform sheet processing (referred to as finishing or post processing) on a sheet of a job onto which printing is performed with the printer unit 203 (referred to as print product or printing medium). In addition, each of the sheet processing apparatuses 200 is configured so that the user can take out the print product onto which the sheet processing is performed by each sheet processing apparatus 200. Furthermore, the printing system 1000 is configured so that the sheets used in the job printed with the printer unit 203 can be selectively supplied from the printer unit 203 of the printing apparatus 100 to the plurality of sheet processing apparatuses 200.

Moreover, the printing apparatus 100 includes a plurality of paper feed units (the paper feed cassettes 317 and 318). Furthermore, an optional paper feed unit (the paper feed deck 319) can be connected to the printing apparatus 100.

As described above, a plurality of paper feed units that can be used in printing exist in the printing system 1000. In addition, the printing system 1000 is configured so that all of the plurality of paper feed units or at least one or more paper feed units can be configured as a key-equipped paper feed unit.

The key-equipped paper feed unit can include a physical key or an electronic locking function. The key-equipped paper feed unit can take an arbitrary shape and have arbitrary characteristics as long as the key-equipped paper feed unit can implement the configuration described below.

The printing system 1000 according to an exemplary embodiment includes a plurality of paper feed units corresponding to an electronic lock. The control unit 205 controls the state of locking of the plurality of paper feed units corresponding to an electronic lock and performs various types of control according to information about the locking state.

In an exemplary embodiment, the control unit 205 controls the printing system 1000 so that the printing system 1000 can perform a first operation. The first operation refers to an operation in which the printing system 1000 completely performs the print operation required to be performed in one job to be processed, by allowing, after the printing apparatus 100 has consumed all of printing media stored in one paper feed unit, the printing apparatus 100 to use printing media stored in another paper feed unit.

In an exemplary embodiment, the control unit 205 controls a user interface (UI) unit so that an instruction for inhibiting the printing system 1000 from performing the first operation can be received from a user. When a "prioritize productivity" key is pressed and selected by the user via a UI screen to be described later below, the control unit 205 determines that the instruction for inhibiting the performance of the first operation is entered by the user.

If the instruction generated via the "prioritize productivity" key, which is equivalent to the instruction for inhibiting the performance of the first operation (if the instruction is not entered yet), then the control unit 205 allows the printing system 1000 to perform the first operation.

On the other hand, if the "prioritize productivity" key is pressed and selected by the user (if the instruction has been entered), then the control unit 205 inhibits performance of the first operation by the printing system 1000. In this case, the control unit 205 controls the printing system 1000 so that the printing system 1000 performs a second operation instead of performing the first operation.

In the second operation according to an exemplary embodiment, the control unit 205 performs control so that a part of the printing media stored in one paper feed unit is used in the print operation performed with the printing apparatus 100. The control unit 205 controls the printing apparatus 100 so that the printing apparatus 100 continuously performs the print operation of the job to be processed using the one paper feed unit until the remaining amount of printing media stored in the one paper feed unit reaches a predetermined amount.

The predetermined amount is a small value that is at least greater than zero, such as ten, and is smaller than the maximum amount of storable printing media that can be set in the one paper feed unit. When the remaining amount of printing media in the one paper feed unit has reached the predetermined amount, the printing apparatus 100 continues the operation for performing printing of the job using printing media stored in another paper feed unit without stopping the print operation in the state where the printing media in the one paper feed unit are not fully consumed and still remaining.

Thus, the printing system 1000 completely performs the print operation required to be performed in one job to be processed. The series of operations is equivalent to the second operation. In an exemplary embodiment, the control unit 205 performs control so that the printing system 1000 performs the second operation when the "prioritize productivity" key is selected by the user.

With the printing system 1000 capable of performing the first operation, the following useful effects can be obtained.

For example, efficiency of using printing media in one paper feed unit of a plurality of paper feed units included in the printing system 1000 can be improved. Thus, processing can be effectively performed even when print requests of various kinds of print jobs that need to use various kinds of printing media are intensively received at the same time.

With the above-described configuration, the printing system 1000 can meet the needs of preventing wasteful occupation of resources used in printing (printing media) in one print job. Furthermore, a problem such that one print job wastefully occupies a plurality of paper feed units can be prevented from occurring. Moreover, a problem such that printing of another job is suspended due to the above-described problem to affect the productivity of the other pending jobs can be prevented from occurring.

With the printing system 1000 according to an exemplary embodiment, the useful effect from the first operation can be obtained.

In addition, with the configuration in which the printing system 1000 can perform the second operation, the following useful effects from the second operation can be obtained.

For example, by effectively using a plurality of paper feed units, the time taken from the start of printing of each print job to the end thereof can be shortened, and thus the productivity in performing each print job can be improved. Furthermore, a problem such that the print operation is insignificantly suspended due to the full consumption of printing media stored in one paper feed unit can be prevented from occurring. Moreover, a downtime occurring due to an occurrence of the above-described circumstance can be prevented. With the printing system 1000 according to an exemplary embodiment, the useful effects from the second operation can be obtained.

In an exemplary embodiment, the control unit 205 can control the printing system 1000 so that the performance of the first operation is inhibited and the second operation is performed. As described above, the control unit 205 controls the printing system 1000 so that the first and the second operations can be selectively performed by the printing system 1000. As described above, with the printing system 1000 according to an exemplary embodiment, both the useful effects from the first operation and the useful effects from the second operation can be selectively obtained.

In an exemplary embodiment, the control unit 205 receives information about the remaining amount of sheets set on the paper feed cassette 317. In addition, the printer unit 203 detects the remaining amount of sheets stored in the paper feed cassette 317 in the following exemplary method.

For example, suppose that the user has opened the paper feed cassette 317 to replenish sheets. Then, a lifter 324 moves downward to contact the bottom surface of the paper feed cassette 317.

After that, the user sets paper sheets on the lifter 324 to replenish sheets into the paper feed cassette 317. Subsequently, when the user closes the paper feed cassette 317, the lifter 324 moves upward so that the replenished sheets contact a paper feed roller 321.

At this time, a sensor 323 mounted in the paper feed cassette 317 detects the passage of the lifter 324. The sensor 323 measures the time taken from the start of moving downward of the lifter 324 performed according to the replenishment of sheets to the return of the lifter 324 to the initial position.

Thus, the lifter 324 detects the height of paper sheets existing on the lifter 324 (detects the stacking amount of sheets).

The printer unit 203 estimates the number of paper sheets existing in the paper feed cassette 317 according to information about the height of paper sheets (stacking amount of sheets) and information about the paper sheets transmitted from the control unit 205 (type, grammage, surface characteristics, and shape of paper) to be described later below.

In the state where the number of paper sheets is estimated, when the printer unit 203 receives a print instruction from the control unit 205, the printer unit 203 starts the print operation. The printer unit 203 decrements the number of paper sheets by one every time one sheet is printed.

Thus, the printer unit 203 is capable of determining whether the remaining amount of paper sheets in the paper feed cassette 317 has reached a predetermined amount. The printer unit 203 notifies the result of the remaining sheet amount determination to the control unit 205.

Furthermore, the printer unit 203 is capable of determining whether the remaining amount of paper sheets has reached a predetermined amount with respect to the paper feed cassette 318 and the paper feed deck 319 using sensors 325 and 327. The printer unit 203 notifies the result of the remaining sheet amount determination to the control unit 205.

The printer unit 203 operates the pickup roller 321 while operating the lifter 324 to convey the paper sheets stacked in the paper feed cassette 317. Here, suppose that at this time, a state where the pickup roller 321 cannot pick up a sheet from the paper feed cassette 317 although the lifter 324 has been moved to such a position as to enable feeding of sheets has occurred. With such a state, the printer unit 203 detects that paper sheets in the paper feed cassette 317 have been fully consumed.

In addition, the printer unit 203 detects that paper sheets in the paper feed cassette 318 and the paper feed deck 319 have been fully consumed with the processing similar to the processing described above. Then, the printer unit 203 notifies the result of the detection to the control unit 205.

The control operation concerning the above-described first and second operations will now be described below with reference to FIGS. 11 through 26.

First, the above-described first operation to be performed in the printing system 1000 will be described below.

Figure 11:
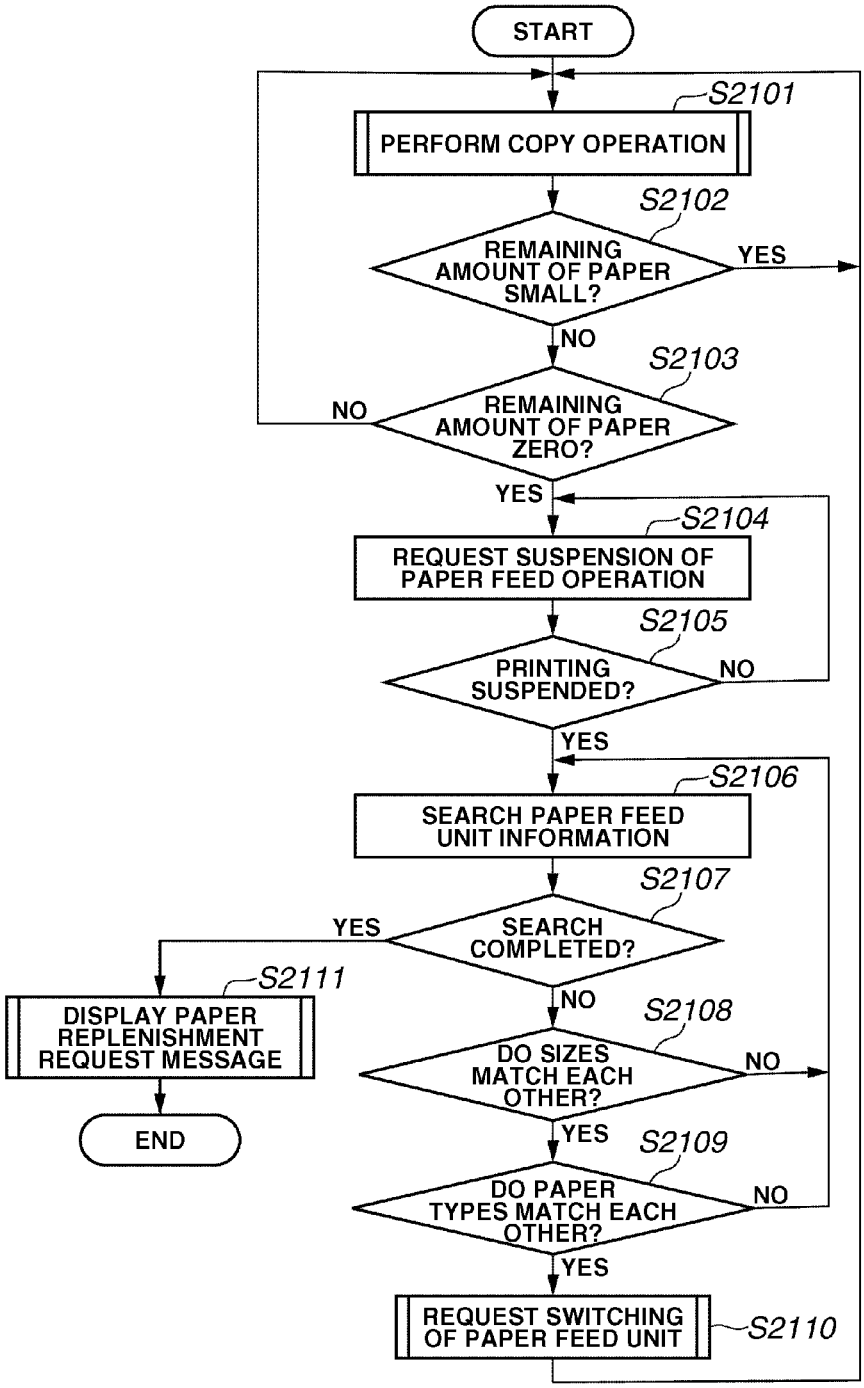
FIG. 11 is a flow chart illustrating processing performed when no paper remains in a paper feed cassette according to an exemplary embodiment of the present invention.

FIG. 11 is a flow chart illustrating an example of a first control sequence for controlling the printing system 1000 to perform the first operation according to an embodiment. The control unit 205 detects, while performing the print operation using one paper feed unit to be used in a job to be printed (for example, any one of the paper feed cassettes 317 and 318 and the paper feed deck 319), that paper sheets stacked in the paper feed unit have been completely consumed.

After that, the control unit 205 allows the printing system 1000 to continue the print operation of the job using another paper feed unit. The processing illustrated in FIG. 11 corresponds to the control sequence used in performing the series of operations.

The processing illustrated in the flow chart of FIG. 11 is previously stored in a memory of the printing apparatus 100 as a computer-readable program. The processing illustrated in FIG. 11 is performed by reading and executing the program with the control unit 205. The control unit 205 executes the first control sequence to allow the printing system 1000 to perform the first operation.

First, the user performs various settings via the screens illustrated in FIGS. 7 and 8 displayed on the touch panel 401. After that, the user presses the start key 503. Then, in step S2101, the control unit 205 reads a document placed in the scanner unit 201, stores image data on the HDD 209 via the compression/decompression unit 210, and performs the print operation of the job with the printer unit 203.

In performing the print operation of the job, the control unit 205, according to the print operation set by the user via the UI unit, identifies a paper feed unit to be used in printing the job, conveys paper sheets from the paper feed unit, and performs printing with the printer unit 203.

In step S2102, during the print operation, the control unit 205 checks whether the remaining amount of paper in the paper feed unit has reached the above-described predetermined amount equivalent to a small remaining amount based on the sensor information from the printer unit 203.

In the first control sequence, if the remaining amount of paper in the currently-used paper feed unit has reached the predetermined amount (YES in step S2102), then the control unit 205 controls the printing apparatus 100 so that the printing apparatus 100 continues to use the paper feed unit to continue performing the print operation of the job. On the other hand, if the remaining amount of paper has not reached the predetermined amount (NO in step S2102), then the control unit 205 advances from step S2102 to step S2103.

In step S2103, the control unit 205 checks whether the remaining amount of paper in the paper feed unit used in the print operation has become zero (whether a state "remaining amount of paper zero" has occurred) according to the sensor information from the printer unit 203.

If it is detected that the remaining amount of paper in the paper feed unit is not zero (NO in step S2103), then the control unit 205 returns to step S2101. Thus, the control unit 205 continues to use the paper feed unit to allow the printing apparatus 100 to continue performing the print operation of the job.

On the other hand, if it is detected that the remaining amount of paper in the currently-used paper feed unit has become zero (YES in step S2103), then the control unit 205 advances to step S2104.

As described above, in the first control sequence, the information indicating that the state "remaining amount of paper zero" has occurred in the paper feed unit currently used in the print operation is notified from the printer unit 203 to the control unit 205 during the print operation. In this case, the control unit 205 advances from step S2103 to step S2104. In step S2104, the control unit 205 generates a request for suspending the paper feed operation to the printer unit 203.

In step S2105, the control unit 205 detects whether the print operation by the printer unit 203 has been suspended (stopped). In suspending the print operation, the control unit 205 allows the printing system 1000 to perform a series of operations including outputting all of the sheets on which print data is already printed to a discharge destination of the job without clogging in the sheet conveyance path in the printing system 1000.

If it is detected in step S2105 that the print operation of the job has been suspended by the printing system 1000, then the control unit 205 advances from step S2105 to step S2106. On the other hand, if it is detected in step S2105 that the print operation of the job has not been suspended by the printing system 1000, then the control unit 205 returns to step S2104 to wait for the print operation to be suspended.

When it is detected in step S2105 that the print operation by the printer unit 203 has been suspended according to the request generated in step S2104, then in step S2106, the control unit 205 reads and verifies the information about paper sheets in paper feed units that can be used by the printing system 1000 from the RAM 208.

Suppose that a plurality of paper feed units other than the above-described paper feed unit exist in the printing system 1000. In this case, the control unit 205 searches the information for verifying the size and type (medium type) of paper sheets set in the paper feed units from the RAM 208.

On the other hand, the control unit 205 verifies the size and type (medium type) of paper sheets necessary for the print operation of the job. At this time, the control unit 205 performs the verification according to the print processing condition of the job set by the user via the UI unit in step S2101 in advance of the start of printing of the job.

After that, the control unit 205 collates the information about the paper sheets set in the paper feed unit of the printing system 1000 with the information about the paper sheets necessary for the job to search for a paper feed unit that can be used to continue the print operation of the job. The search about whether a paper feed unit that can be used to continue the print operation exists is performed once for each paper feed unit of the plurality of paper feed units that can be used in the printing system 1000.

For example, in step S2106, the control unit 205 searches the size and type of paper sheets set in one paper feed unit to be selected (any one of the paper feed cassettes 317 and 318, the paper feed deck 319, and the manual feed tray 320). In step S2107, the control unit 205 detects whether all of the paper feed units to be selected have been searched.

If it is determined in step S2107 that not all of the paper feed units have been searched (that a paper feed unit to be searched still remains), then the control unit 205 advances from step S2107 to step S2108. In step S2108, the control unit 205 collates the size of paper sheets set in the paper feed unit that has been searched for the above-described information in step S2106 with the size of paper sheets set in the paper feed unit whose remaining paper amount has been detected to become zero in step S2103.

If it is detected in step S2108 that the sizes of both paper sheets do not match each other, then the control unit 205 returns from step S2108 to step S2106 to perform the search of another paper feed unit that can be selected.

On the other hand, if it is detected that the paper sizes match each other, then the control unit 205 advances from step S2108 to step S2109. In step S2109, the control unit 205 collates the type of paper sheets set in the paper feed unit that has been searched for the above-described information in step S2106 with the type of paper sheets that have been set in the paper feed unit whose remaining paper amount has become zero in step S2103.

If it is determined in step S2109 that the paper types do not match each other, then the control unit 205 returns from step S2109 to step S2106 to search for another paper feed unit that can be selected.

On the other hand, if it is determined in step S2109 that the paper types match each other, then the control unit 205 advances from step S2109 to step S2110. In step S2110, the control unit 205 requests switching of paper feed units used in the print operation to the printer unit 203.

This case is equivalent to a case where another paper feed unit with which the print operation of the job that has been suspended in step S2104 exists in the printing system 1000. In this case, in step S2110, the control unit 205 generates a request for switching the paper feed unit used by the printing apparatus 100 to the searched paper feed unit to the printer unit 203. Then, the control unit 205 returns from step S2110 to step S2101.

Thus, the control unit 205 allows the printing system 1000 to continue the print operation of the job using the searched paper feed unit.

Here, if it is determined by the control unit 205 in step S2107 that all of the paper feed units that can be selected have been searched (that no paper feed unit to be searched exists in the printing system 1000), then the control unit 205 advances from step S2107 to step S2111.

In step S2111, the control unit 205 reports (displays) a message for prompting the user to replenish paper sheets necessary for continuing the print operation of the job on the UI unit. Thus, if a paper feed unit in which paper sheets suitable for continuing the print operation of the job suspended in step S2104 are set is not detected, then the control unit 205 advances to step S2111. In step S2111, the control unit 205 displays a message indicating that a paper feed unit in which paper sheets suitable for continuing the print operation of the job suspended in step S2104 are set is not detected on the touch panel 401.

With the first control sequence described with reference to FIG. 11, the control unit 205 allows the printing system 1000 to perform the first operation.

Figure 12:
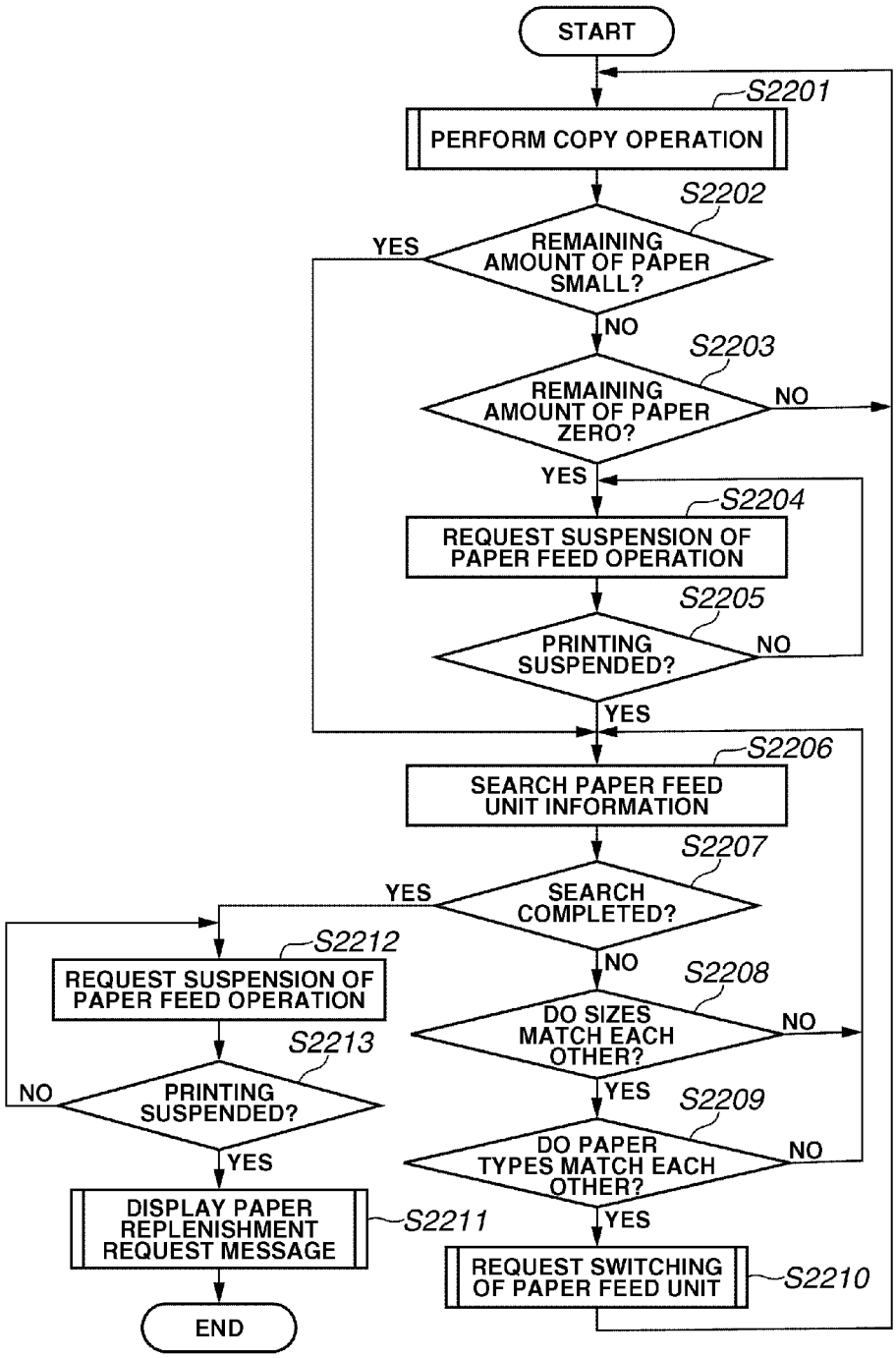
FIG. 12 is a flow chart illustrating processing performed when the amount of paper in the paper feed cassette reaches a predetermined amount according to an exemplary embodiment of the present invention.

The second operation performed by the printing system 1000 will now be described below. FIG. 12 is a flow chart illustrating an example of a second control sequence for controlling the printing system 1000 to perform the second operation according to an embodiment.

The control unit 205 detects, while performing a print operation using one paper feed unit to be used in a job to be printed (for example, any one of the paper feed cassettes 317 and 318 and the paper feed deck 319), whether the remaining amount of paper in the paper feed unit has reached the predetermined amount greater than zero. If it is detected that the remaining amount of paper in the paper feed unit has reached the predetermined amount greater than zero, then the control unit 205 continues the operation for performing printing of the job in the printing system 1000 using another paper feed unit without stopping the print operation in the state where the paper sheets in the paper feed unit are not fully consumed and still remaining.

The processing illustrated in FIG. 12 corresponds to the control sequence used in performing the series of operations. The processing illustrated in the flow chart of FIG. 12 is previously stored in a memory of the printing apparatus 100 as a computer-readable program.

The processing illustrated in FIG. 12 is performed by reading and executing the program with the control unit 205. The control unit 205 executes the second control sequence to allow the printing system 1000 to perform the second operation.

In step S2201 in FIG. 12, the control unit 205 performs processing similar to the processing in step S2101 in FIG. 11. Thus, the control unit 205 allows the printing system 1000 to perform the print operation using the paper feed unit in which paper sheets of the size and type based on the print condition set by the user are set.

During the print operation of the job that has been started in step S2201, the control unit 205, in step S2202, performs checking processing similar to the processing in step S2102 in FIG. 11. That is, in step S2202, during the print operation, the control unit 205 checks whether the remaining amount of paper in the paper feed unit has reached the above-described predetermined amount (remaining amount small) according to the sensor information from the printer unit 203.

In the second control sequence, if the remaining amount of paper in the currently-used paper feed unit has reached the predetermined amount (YES in step S2102), then the control unit 205 controls the printing apparatus 100 to inhibit continuously using the paper feed unit to continue performing the print operation of the job. If the remaining amount of paper has reached the predetermined amount (YES in step S2202), then the control unit 205 advances from step S2202 to step S2206 without shifting to the processing in step S2204.

Thus, the control unit 205 controls the printing system 1000 so that the printing system 1000 automatically continues the print operation using paper sheets in another available paper feed unit without temporarily suspending the print operation, in the state where paper sheets in the paper feed unit whose remaining amount of paper has reached the predetermined amount remain as they are.

In step S2206, the control unit 205 searches, from the RAM 208, information about the size and type (medium type) of paper sheets in the paper feed units existing in the printing system 1000 without suspending the print operation. As described above, the control unit 205 searches for another paper feed unit with which the print operation can be continued.

In step S2207, the control unit 205 detects whether all of the paper feed units with which the print operation can be continued have been completely searched.

If it is detected that the search has not been completed (that a paper feed unit to be searched still remains), then the control unit 205 advances from step S2207 to step S2208. In step S2208, the control unit 205 collates the size of paper sheets set in the paper feed unit searched for information in step S2206 with the size of paper sheets remaining in the paper feed unit whose remaining amount of paper has been detected.

If the paper sheet sizes do not match each other, the control unit 205 returns from step S2208 to step S2206 to shift to the search for another paper feed unit.

On the other hand, if it is detected in step S2208 that the paper sheet sizes match each other, the control unit 205 advances from step S2208 to step S2209. In step S2209, the control unit 205 collates the type of paper sheets set in the paper feed unit searched for information in step S2206 with the type of paper sheets remaining in the paper feed unit whose remaining amount of paper has been detected.

If it is determined in step S2209 that the paper sheet types do not match each other, then the control unit 205 returns from step S2209 to step S2206 to shift to the search for another paper feed unit.

On the other hand, if it is detected that the paper sheet types match each other, then the control unit 205 advances from step S2209 to step S2210. In step S2210, the control unit 205 generates a request for switching paper feed units to be used to the printer unit 203 so that the printer unit 203 continues the print operation using the searched paper feed unit.

Then, the control unit 205 returns to step S2201 to allow the printing apparatus 100 to continue the print operation of the job using the paper sheets in the searched paper feed unit.

Thus, in the second control sequence, the processing according to such a flow as step S2201→YES in step S2202→step S2206→NO in step S2207→YES in step S2208→YES in step S2209→step S2210→step S2201 is performed. Thus, the control unit 205 allows the printing system 1000 to perform the second operation.

That is, the control unit 205 controls the printing system 1000 so that the printing system 1000 automatically controls the print operation of the job using paper sheets in the second paper feed unit without temporarily stopping the print operation of the job in the state where the paper sheets in the predetermined amount are remaining in the first paper feed unit used in the print operation of the job.

Here, if it is determined by the control unit 205 in step S2207 that all of the paper feed units to be selected have been searched (that no paper feed unit to be searched exists in the printing system 1000), then the control unit 205 advances from step S2207 to step S2212. In step S2212, the control unit 205 generates a request for suspending the paper feeding operation to the printer unit 203.

Thus, the control unit 205 allows the printing system 1000 to suspend (temporarily stop) the print operation of the job. In step S2213, the control unit 205 waits until the printing system 1000 suspends the print operation of the job, and then advances to step S2211.

In step S2211, the control unit 205 displays a message prompting the user to replenish paper sheets necessary for continuing the print operation of the job on the touch panel 401.

Here, if it is determined in step S2202 that the remaining amount of paper in the paper feed unit used in the job, while the print operation is being performed in step S2201, is not the above-described predetermined amount (remaining amount small) according to the information from the printer unit 203, then the control unit 205 advances from step S2202 to step S2203.

In step S2203, the control unit 205 detects whether the remaining amount of the paper sheets in the paper feed unit is zero according to the information from the printer unit 203. If it is determined in step S2203 that the remaining amount of paper in the paper feed unit is not zero (paper remaining), then the control unit 205 returns from step S2203 to step S2201 to allow the printing apparatus 100 to continue the print operation of the job continuously using the paper feed unit.

On the other hand, if it is determined in step S2203 that the remaining amount of paper in the paper feed unit is zero according to the information from the printer unit 203, then the control unit 205 advances to step S2204. In step S2204, the control unit 205 generates a request for suspending the paper feed operation to the printer unit 203.

Thus, the control unit 205 suspends (temporarily stops) the print operation of the job. In step S2205, the control unit 205 waits until the printing system 1000 stops the print operation, and then advances to step S2206.

Suppose that the processing has shifted to step S2206 via steps S2202, S2203, S2204, and S2205. In this case, in steps S2206 to S2209, the control unit 205 searches for another paper feed unit with which the print operation of the job whose print operation has been suspended can be continued.

In this case, the control unit 205 performs the processings similar to those in steps S2106 through S2111.

The processing in which the control unit 205 receives setting data for switching the processing in the operation flows in FIGS. 11 and 12 (namely, switching between the first and second operations) from the user via the UI unit will now be described below.

Figure 13:
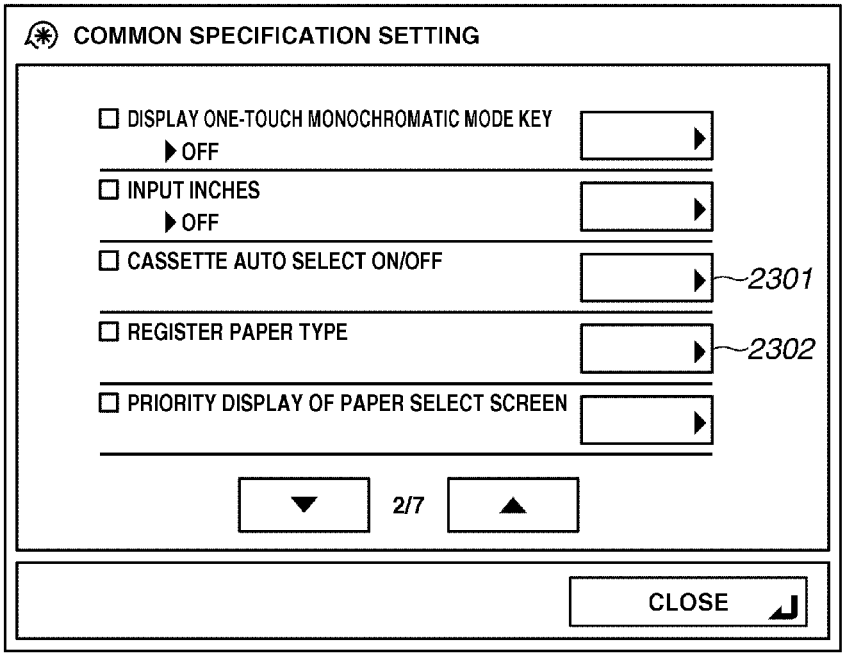
FIG. 13 illustrates a setting screen displayed in an operation unit according to an exemplary embodiment of the present invention.

When the control unit 205 detects that the user mode key 505 in the operation unit 204 is pressed by the user, the control unit 205 displays a common specification setting screen illustrated in FIG. 13 on the touch panel 401.

Figure 14:
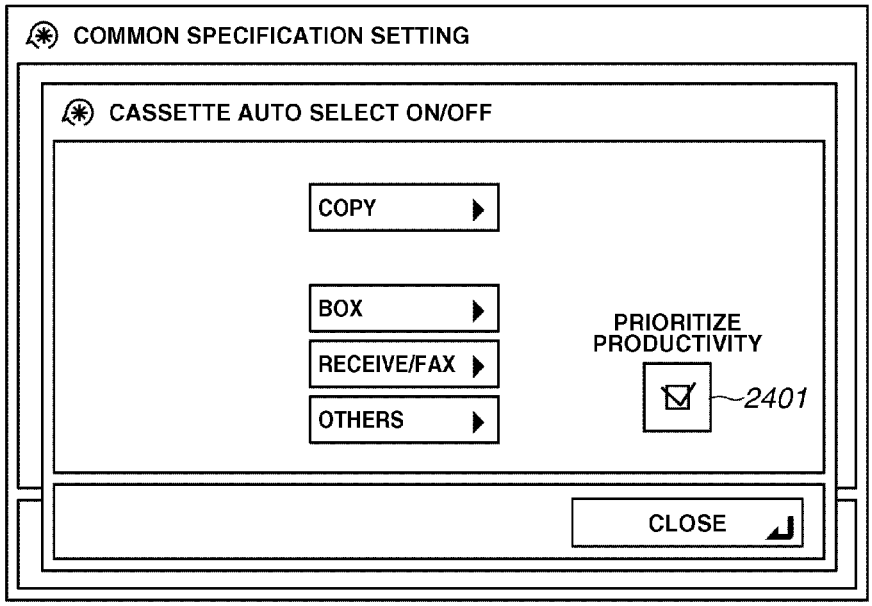
FIG. 14 illustrates a setting screen displayed in an operation unit according to an exemplary embodiment of the present invention.

When a "cassette auto select ON/OFF" key 2301 in the screen in FIG. 13 is pressed (touched to be selected) by the user, the control unit 205, upon the key operation by the user, displays a cassette auto select ON/OFF screen illustrated in FIG. 14 on the touch panel 401.

When a "prioritize productivity" key 2401 illustrated in FIG. 14 is pressed (touched to be selected) by the user, the control unit 205, upon receiving of the key input, determines that the second control sequence (namely, the second operation) described with reference to FIG. 12 is selected by the user.

The control unit 205 stores the result of the user selection on the RAM 208 as setting data equivalent to registration information. Suppose that the data equivalent to the instruction for performing the second operation is set on the RAM 208.

In this case, the control unit 205 controls the printing system 1000 so that performance of the first operation is inhibited in the printing system 1000 and that the printing system 1000 performs the second operation. That is, the printing system 1000 performs the operation according to the operation flow illustrated in FIG. 12.

On the other hand, if the key 2401 is not pressed by the user (that is, if the productivity prioritization mode is OFF), the setting data is not set on the RAM 208.

In this case, the control unit 205 controls the printing system 1000 so that performance of the second operation by the printing system 1000 is inhibited and that the printing system 1000 performs the first operation. That is, the printing system 1000 performs the operation according to the operation flow illustrated in FIG. 11.

As described above, the control unit 205 detects whether the setting data corresponding to the instruction for inhibiting the first operation and performing the second operation is previously set on the RAM 208. Based on the detection result, the control unit 205 controls switching as to which of the first and second operations is to be performed.

Thus, the control unit 205 determines whether to allow the printing system 1000 to perform the processing for continuing the print operation by changing paper feed units to be used without suspending the print operation (the second operation). If the second operation is determined not to be performed, the control unit 205 allows the printing system 1000 to perform the processing for continuing the print operation by changing paper feed units to be used after the print operation is suspended (the first operation).

Another specific example related to the control by the control unit 205 will now be described below. The above-described control example is equivalent to the configuration with which the control unit 205 receives an instruction for performing the second operation from the user via the key 2401 as the device setting for the printing system 1000.

That is, in the above-described configuration, the productivity prioritization mode can be set. When the productivity prioritization mode is set, the control unit 205 controls the printing system 1000 so that the printing system 1000 performs, in the productivity prioritization mode (namely, according to the second operation), the processing of all of the jobs received by the printing apparatus 100 during the time period in which the productivity prioritization mode is ON.

On the other hand, in the following control example, the control unit 205 determines whether each of a plurality of jobs received by the printing system 1000 is to be processed in the productivity prioritization mode. That is, in the following exemplary configuration, whether the first operation is to be performed or the second operation is to be performed can be determined separately per each print job.

This exemplary configuration will be described below.

Figure 16A:
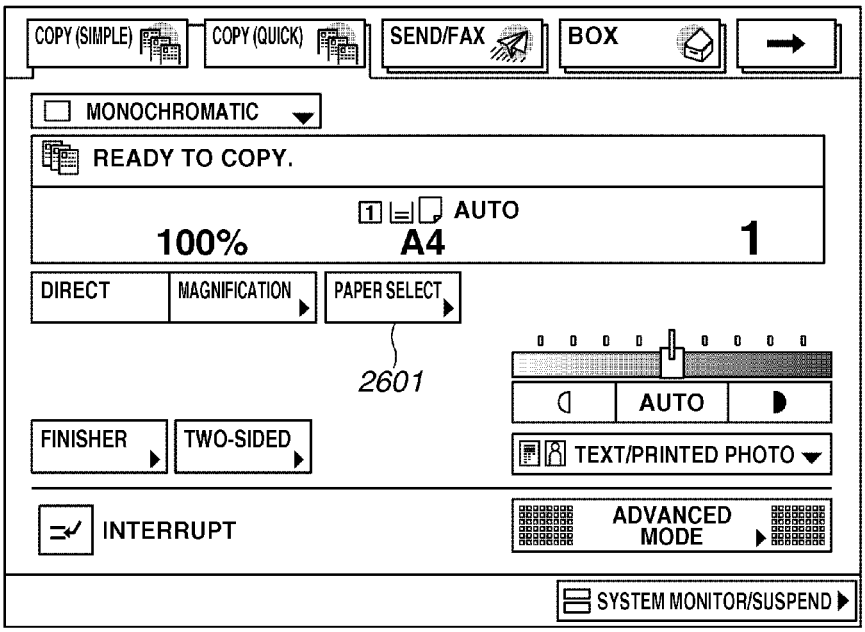
FIG. 16A illustrates a setting screen displayed in an operation unit according to an exemplary embodiment of the present invention.

For example, suppose that the control unit 205 has displayed a print setting screen illustrated in FIG. 16A on the touch panel 401. In addition, suppose that in advance of the start of the print operation of a print job to be processed, the control unit 205 receives a print condition for the job from the user via the screen illustrated in FIG. 16A.

Figure 16B:
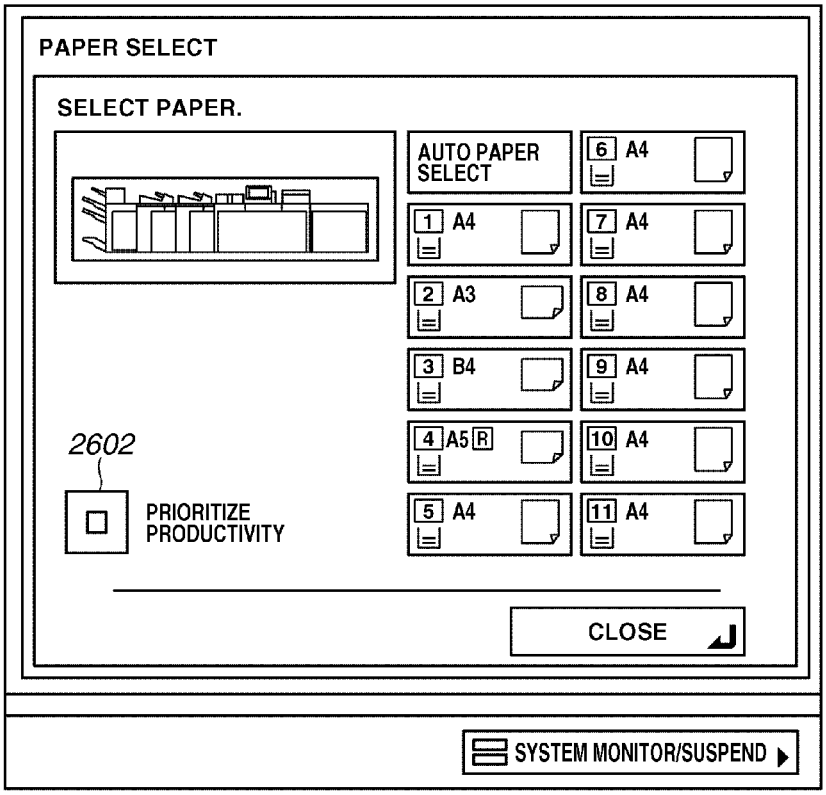
FIG. 16B illustrates a setting screen displayed in an operation unit according to an exemplary embodiment of the present invention.

When the user has pressed a key 2601 in FIG. 16A, the control unit 205 displays a screen illustrated in FIG. 16B on the touch panel 401. The control unit 205 receives an instruction for selecting paper to be used in printing of the job from the user via the screen illustrated in FIG. 16B.

Thus, the user can determine and designate the size and type of the paper used in the printing system 1000 in the print operation of the job via the screen illustrated in FIG. 16B.

The screen in FIG. 16B includes a key 2602 for inputting an instruction for performing the second operation (for setting the productivity prioritization mode) for the job.

For example, when the user presses the key 2602, the control unit 205 controls the printing system 1000 so that the printing system 1000 performs the productivity prioritization mode (the second operation) for the job.

On the other hand, if the user does not select the key 2602 (if the key 2602 is OFF), the control unit 205 controls the printing system 1000 so that the printing system 1000 does not perform (inhibits) the productivity prioritization mode for the job. In this case, the control unit 205 controls so that the printing system 1000 performs the first operation without performing the second operation for the job.

As described above, the control unit 205 controls the operation unit 204 so that the user can make a selection as to whether the first operation is to be performed or the second operation is to be performed for the job in advance of receiving a print request of a job to be processed from the user via the screen in FIG. 16B.

The control unit 205 controls the operation unit 204 so that the user can make the selection differently for each of the plurality of jobs to be processed. Thus, the switching between the first and the second operations can be performed per each of the plurality of jobs.

When the control unit 205 receives the print request made via the operation of the start key 503 after the selection is made, the control unit 205 registers the processing condition for the job to be processed on the memory of the printing apparatus 100. If a plurality of jobs to be printed exists, the control unit 205 registers information for allowing the control unit 205 to identify which of the first and the second operations is to be performed per each job on the memory of the printing apparatus 100.

For example, the setting data defining the print condition for each job received from the user via the operation unit 204 and the various setting screens illustrated in FIGS. 16A and 16B is stored on the RAM 208 as data 2501 in a table format illustrated in FIG. 15.

The table data 2501 illustrated in FIG. 15 includes a column 2502 for managing an identification (ID) number of each job whose print request is generated and a column 2503 for managing the type of each job (for example, whether the job is a copy job or a PDL job). In addition, the table data 2501 includes a column 2504 for managing information for identifying a paper feed unit to be used in printing each job.

Furthermore, the table data 2501 includes a column 2505 for managing information for identifying which of the first and the second operations is to be performed for each job. Moreover, the table data 2501 includes a column 2506 for managing information for identifying the number of prints in each job.

In addition, the table data 2501 includes a column 2507 for managing information for identifying whether each job requires saddle stitch binding per each job. Furthermore, the table data 2501 includes a column 2508 for managing information for identifying whether each job requires case binding processing per each job.

Moreover, the table data 2501 includes a column 2509 for managing information for identifying where to discharge the printed paper sheet per each job. As described above, the control unit 205 provides each job with a job ID and registers the setting data generated according to the print processing conditions set by the user in the table data 2501.

The control unit 205 controls the printing system 1000 so that the printing system 1000 processes all of the jobs for which the information "prioritize productivity" is set in the column 2505 in the table data 2501 according to the processing in the flow chart of FIG. 12. That is, when a case where a plurality of paper feed units are used in the print operation of the job for which the description "prioritize productivity" is set in the column 2505 occurs, the control unit 205 controls the printing system 1000 so that the printing system 1000 performs the second operation without performing the first operation.

On the other hand, the control unit 205 controls the printing system 1000 so that the printing system 1000 performs the processing in the flow chart of FIG. 11 on all of the jobs for which the description "normal" is set in the column 2505.

As described above, the printing system 1000 can be configured to allow the user to make a selection as to which of the first and second operations is to be performed for each job in advance of printing.

In addition, in a case where the user can make a selection as to which of the first and second operations is to be performed for each job, the printing system 1000 can be configured so that the printing system 1000 can process the job received from an external apparatus. For example, in this case, a print job can be input to the printing apparatus 100 from an external apparatus, such as the PC 104 in FIG. 1, and the printing system 1000 can perform either of the first and second operations designated for the job. A specific example of the configuration in this case will be described below.

Figure 17:
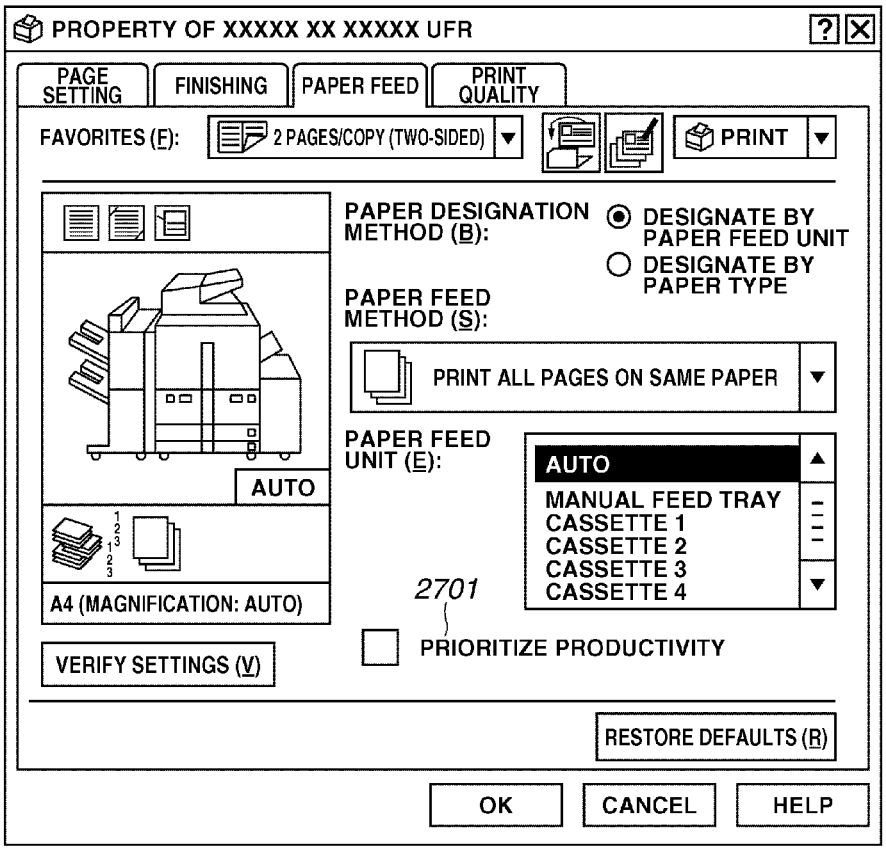
FIG. 17 illustrates a setting screen for a printer driver used in a client personal computer (PC) according to an exemplary embodiment of the present invention.

For example, when a printer driver is activated according to the user operation via the PC 104, which is an example of the external apparatus that can perform data communication with the printing system 1000 via the network 101 in FIG. 1, the CPU of the PC 104 displays a screen illustrated in FIG. 17 on the display unit of the PC 104.

FIG. 17 illustrates an example of a printer driver setting screen for the printing system 1000. The CPU of the PC 104 can receive the selection by the user as to which of the first and second operations is to be performed via a "prioritize productivity" check box 2701 included in the screen in FIG. 17.

Figure 18A:
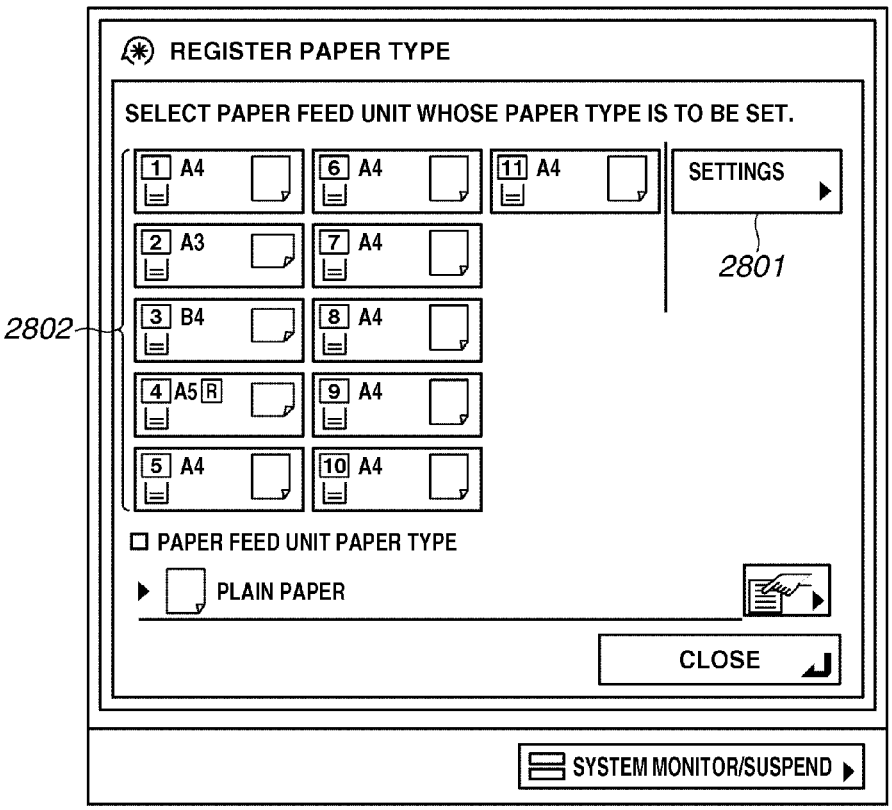
FIG. 18A illustrates a setting screen displayed in an operation unit according to an exemplary embodiment of the present invention.
Figure 18B:
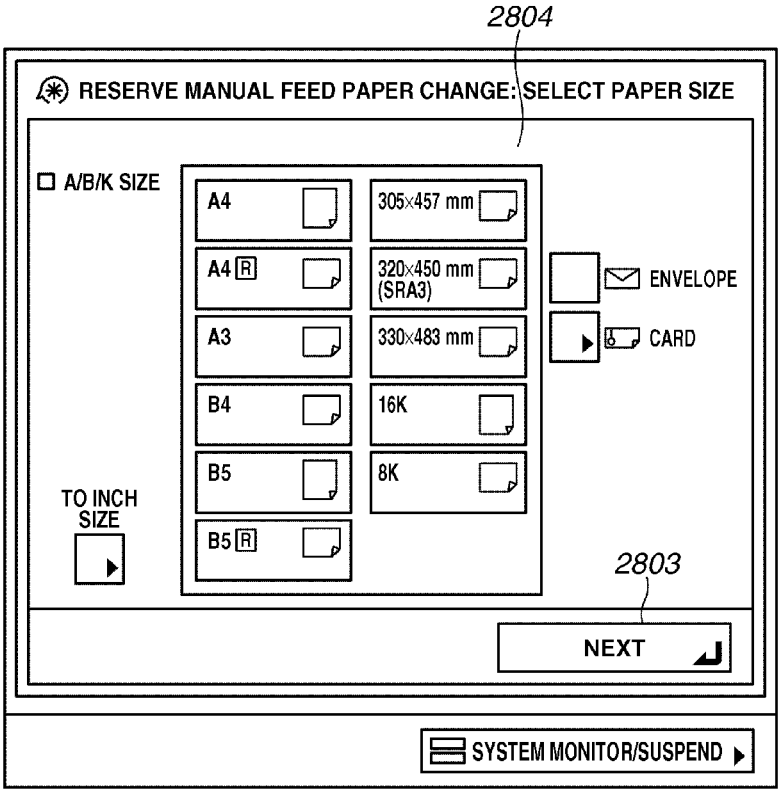
FIG. 18B illustrates a setting screen displayed in an operation unit according to an exemplary embodiment of the present invention.

In addition, the CPU of the PC 104 controls the display unit of the PC 104 so that the display on the PC 104 is switched from the screen illustrated in FIG. 17 to the screen illustrated in FIG. 18A or 18B according to the user operation. Furthermore, the CPU of the PC 104 can receive an instruction for selecting a paper feed unit including selections as to the size and type of paper sheets to be used for printing, which is generated by the user of the PC 104 via the screen illustrated in FIG. 18A or 18B.

When the user of the PC 104 selects the "prioritize productivity" check box 2701 via the screen in FIG. 17, performs settings for various print conditions, and presses the OK key in the screen illustrated in FIG. 17 and when the PC 104 receives the request for performing the job, the CPU of the PC 104 sends the instruction for processing the job with the second operation to the printing system 1000 via the network 101, together with print conditions for the job and data to be printed.

When the control unit 205 receives the job via the external I/F unit 202, the control unit 205, according to the instruction for performing the job, controls the printing system 1000 so that the printing system 1000 processes the job according to the processing in the flow chart of FIG. 12. Thus, the control unit 205 controls the printing system 1000 so that the printing system 1000 performs the second operation without performing the first operation for the job.

On the other hand, when the user does not select the "prioritize productivity" check box 2701 (when the check box 2701 is OFF) via the screen illustrated in FIG. 17, performs the settings of various print conditions, and presses the OK key illustrated in FIG. 17 and when the PC 104 receives the request for performing printing of the job, the CPU of the PC 104 sends the instruction for processing the job with the first operation to the printing system 1000 via the network 101 together with print conditions for the job and data to be printed.

When the control unit 205 receives the job via the external I/F unit 202, the control unit 205, according to the instruction for performing the job, controls the printing system 1000 so that the printing system 1000 processes the job according to the processing in the flow chart of FIG. 11. Thus, the control unit 205 controls the printing system 1000 so that the printing system 1000 performs the first operation without performing the second operation for the job.

As described above, an exemplary embodiment can be configured so that the selection between the first and second operations can be made per each job even when the job is sent from an external apparatus.

Another exemplary control operation according to an exemplary embodiment will now be described below.

In the control example, the control unit 205 performs control so that the user can perform a setting differently for each unit as to whether a paper feed unit is to be utilized in the first operation or the second operation in setting (registering) the size and type (including a thin paper, a plain paper, and a thick paper) per each paper feed unit. Thus, the switching between the first and second operations can be performed according to which of the first and second operations is set for the paper feed unit used in performing printing without determining the operation to be performed per each print job.

For example, when the user presses a key 2302 on the screen in FIG. 13, the control unit 205 displays a screen illustrated in FIG. 18A on the touch panel 401.

Then, the user selects either one of the paper feed units via an option 2802 for the plurality of paper feed units for which the size and type of paper sheets are registered, which is included in the screen illustrated in FIG. 18A.

Subsequently, when the user presses a setting key 2801 in the screen in FIG. 18A, the control unit 205 displays a paper size selection screen illustrated in FIG. 18B on the touch panel 401. Then, the control unit 205 receives, via the screen illustrated in FIG. 18B, the registration of the size of paper sheets to be linked with the paper feed unit selected via the screen in FIG. 18A.

The user can determine and select the paper sheet size to be registered for the selected paper feed unit from among selection options 2804 for the paper sheet size, which are included in the screen illustrated in FIG. 18B.

Figure 19:
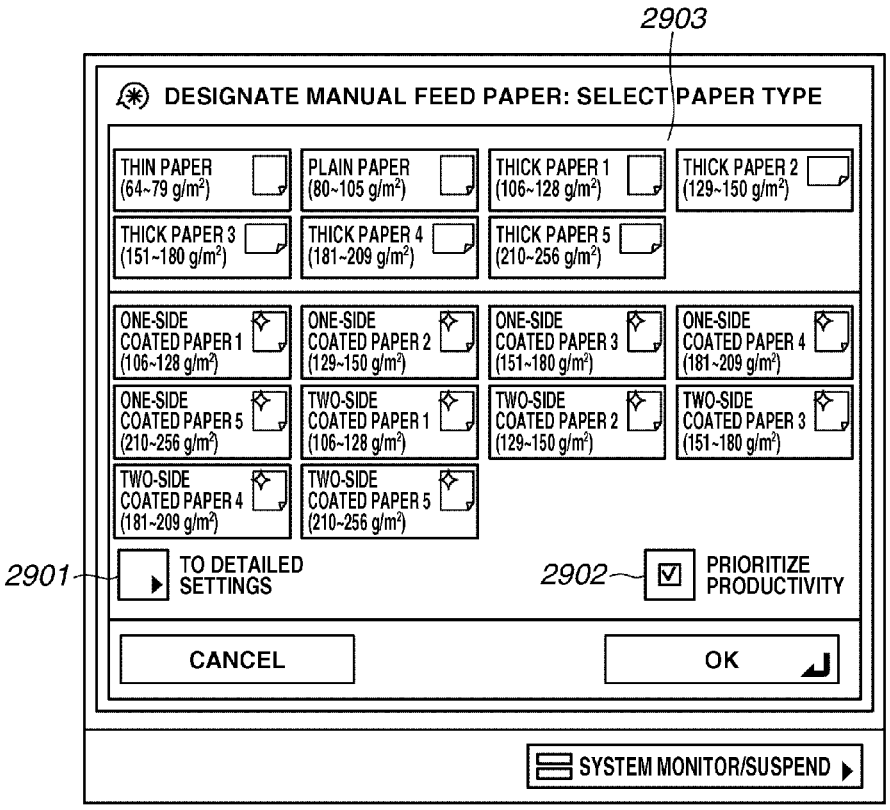
FIG. 19 illustrates a setting screen displayed in an operation unit according to an exemplary embodiment of the present invention.

After the registration of the paper size is completely performed via the screen illustrated in FIG. 18B and when the user presses a "next" key 2803, the control unit 205 displays a screen for registering the paper type illustrated in FIG. 19 on the touch panel 401.

The control unit 205 receives, from the user via the screen illustrated in FIG. 19, the registration of the paper type to be linked with the paper feed unit selected via the screen in FIG. 18A. The user can determine the paper type to be registered for the selected paper feed unit from among paper type selection options 2903 included in the screen in FIG. 19.

When the registration of the paper type is completely performed via the screen in FIG. 19 and when the user presses an OK key in the screen in FIG. 19, the registration of the size and type of paper for the paper feed unit is completed.

In an exemplary embodiment, a "prioritize productivity" key 2902 is included in the screen in FIG. 19.

When the key 2902 is pressed by the user before the user presses the OK key in the screen in FIG. 19, the paper feed unit is registered as a paper feed unit to be used in the productivity prioritization mode.

Thus, the control unit 205 controls the printing system 1000 so that the printing system 1000 handles the paper feed unit as a paper feed unit to be the selection option in the case of performing the second operation in the printing system 1000 when the user selects the key 2902.

On the other hand, when the key 2902 is not selected by the user before the user presses the OK key in the screen in FIG. 19, the paper feed unit is registered as a paper feed unit not to be used in the productivity prioritization mode.

Thus, the control unit 205 controls the printing system 1000 so that the printing system 1000 handles the paper feed unit as a paper feed unit to be the selection option in the case of performing the first operation in the printing system 1000 when the user does not select the key 2902.

By performing the processing in the series of flows described above, the size and type of paper and whether the productivity prioritization mode can be set can be independently registered for each paper feed unit with respect to other paper feed units.

The registration information for the paper feed unit set via each of the screens illustrated in FIGS. 18A, 18B, and 19 is notified from the operation unit 204 to the control unit 205 and is stored in the RAM 208 while being differently identified for each paper feed unit as registration information 3001 of data format illustrated in FIG. 20. The registration information 3001 is notified also to the printer unit 203.

The control unit 205 verifies registration information described in a column 3005 in the paper feed unit registration information 3001. The control unit 205 determines which paper feed unit, among a plurality of paper feed units existing in the printing system 1000, is inhibited from being used when the first operation is to be performed and which paper feed unit is inhibited from being used when the second operation is to be performed.

The control unit 205 controls the printing system 1000 so that a paper feed unit, of a plurality of paper feed units managed with the registration information 3001, which is inhibited from being used when the first operation is to be performed, can be used when the printing system 1000 performs the second operation. For example, in the example illustrated in FIG. 20, two paper feed units, namely, a paper feed unit of ID number "01" and a paper feed unit of ID number "03" in a column 3002, can be selected for the second operation.

Furthermore, the control unit 205 controls the printing system 1000 so that a paper feed unit, of a plurality of paper feed units managed with the registration information 3001, which is inhibited from being used when the second operation is to be performed, can be used when the printing system 1000 performs the first operation. For example, in the example illustrated in FIG. 20, two paper feed units, namely, a paper feed unit of ID number "02" and a paper feed unit of ID number "04" in the column 3002, can be selected for the second operation.

Thus, the switching between the first and second operations can be performed according to the information set for the paper feed units to be used for printing.

Another example of the control operation according to an exemplary embodiment will now be described below. In the above-described control example, ON/OFF of the productivity prioritization mode can be designated for each paper feed unit when the user performs the registration of the size and type of paper sheets for the paper feed unit.

In the control example described below, attribute information that describes a more detailed content than the content of the information about the paper type including plain paper, thick paper, and thin paper can be registered for each paper feed unit. For example, in the example described below, the grammage, surface characteristics, and shape can be registered as the detailed attribute information of the paper sheet linked with the paper feed unit. Furthermore, in addition to these kinds of information, designation as to which of the first and second operations is to be performed can be performed.

In the configuration in which the user can register the detailed attribute information about the paper for each paper feed unit, the setting with which the productivity is prioritized (the setting for switching between the processings illustrated in the control flow in FIGS. 11 and 12) can be performed.

The exemplary configuration will now be described below.

Figure 21:
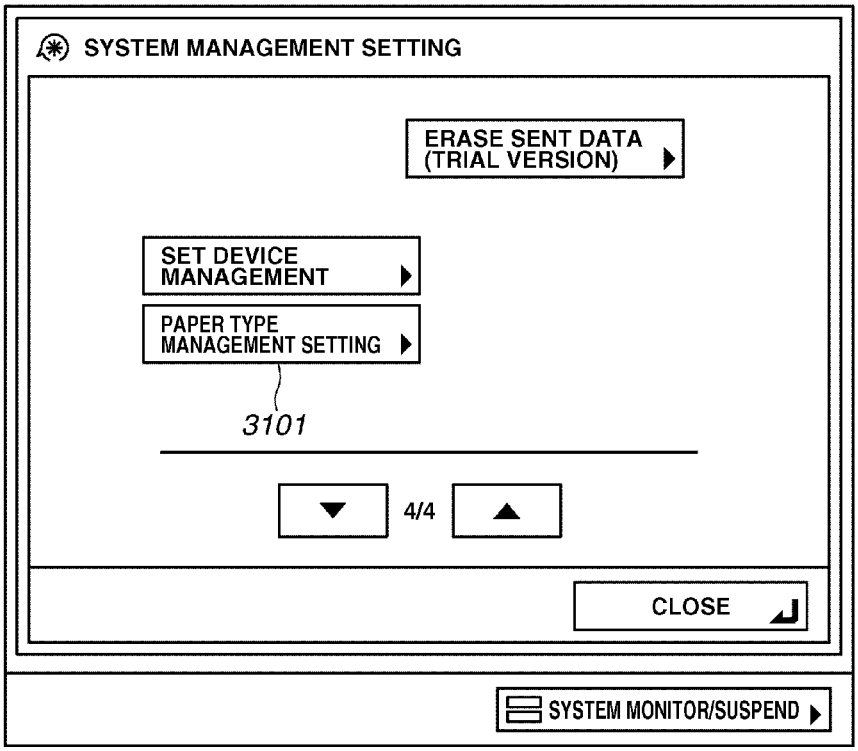
FIG. 21 illustrates a setting screen displayed in an operation unit according to an exemplary embodiment of the present invention.

For example, the control unit 205 controls the touch panel 401 so that after the user presses the user mode key 505, a screen illustrated in FIG. 21 can be displayed on the touch panel 401 according to the instruction generated via the operation unit 204.

Figure 22:
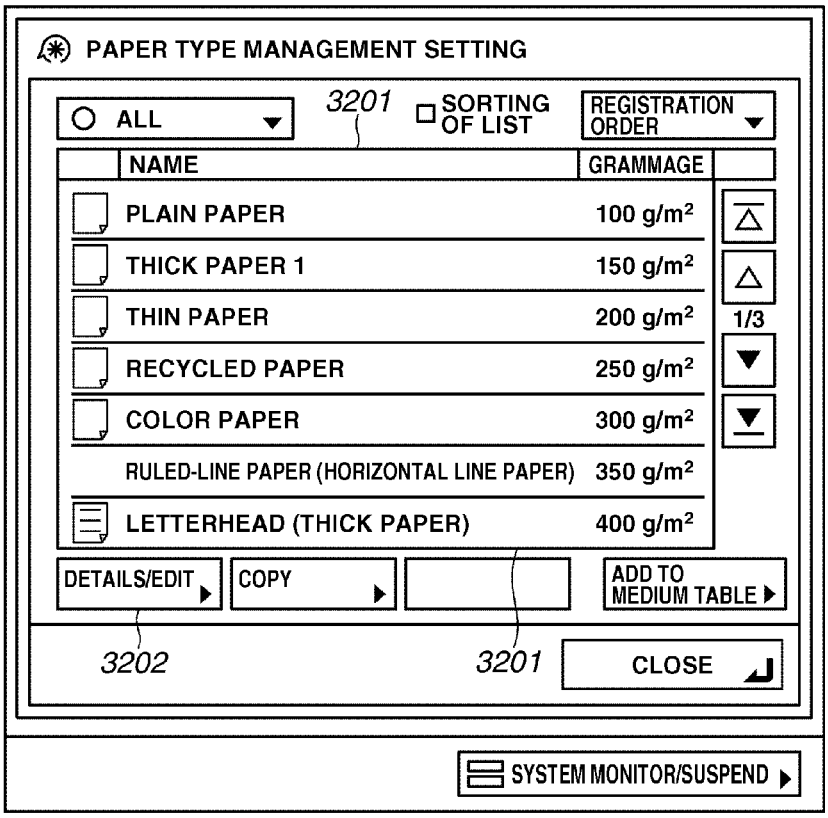
FIG. 22 illustrates a setting screen displayed in an operation unit according to an exemplary embodiment of the present invention.

When a "paper type management setting" key 3101 is pressed by the user via the screen in FIG. 21, the control unit 205 displays a screen illustrated in FIG. 22 on the touch panel 401.

The user can register the detailed attribute information about the paper type via a list 3201 in the screen in FIG. 22. For example, when the user presses a "details/edit" key 3202 in the screen in FIG. 22, the control unit 205 displays a paper attribute details setting screen (not shown) on the touch panel 401.

Via the paper attribute details setting screen, the user can register the information about the paper including the name, grammage, surface characteristics, shape, and color for each paper feed unit as the paper detailed attribute information. The control unit 205 controls the touch panel 401 so that the selection between the first and second operations can be made for each paper feed unit via the paper attribute details setting screen (not shown) with the operation of a key (not shown) similar to the "prioritize productivity" key 2902.

The data thus set is stored in the RAM 208 as paper type information 3301 in a table format illustrated in FIG. 23.

The control unit 205 stores the paper type information 3301 on the RAM 208 and stores information similar to the paper type information 3301 on the HDD 209. After that, the control unit 205 performs control to perform a setting for linking the paper type information generated by the user to the paper feed unit.

Figure 24:
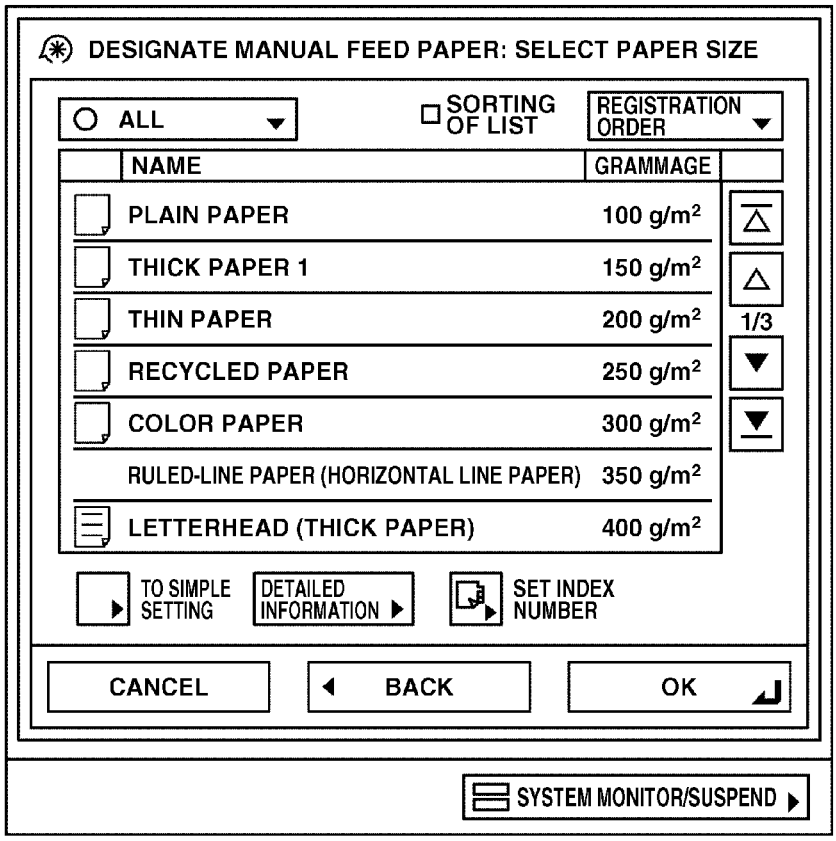
FIG. 24 illustrates a setting screen displayed in an operation unit according to an exemplary embodiment of the present invention.

For example, when a "to detailed settings" key 2901 in the screen in FIG. 19 is pressed by the user, the control unit 205 displays a screen illustrated in FIG. 24 on the touch panel 401.

By selecting an identifier corresponding to the paper type information previously generated by the user via the list in the screen in FIG. 24, the paper type information can be linked to the paper feed unit.

At this time, the control unit 205 acquires the paper type information corresponding to the identifier selected via the list in FIG. 24 from the paper type information 3301 on the RAM 208 and links the paper type information to a paper feed unit to be selected. Thus, the control unit 205 performs control so that the result of the linking can be stored on the RAM 208 as paper feed unit information table data 3501 having a data structure illustrated in FIG. 25.

The control unit 205 also notifies the information illustrated in FIG. 25 also to the printer unit 203. In the example, the paper attribute detailed information that can be linked with each paper feed unit includes information about the name of the paper sheet to be managed using a column 3303 and information about the grammage of the paper managed using a column 3304.

In addition, the paper attribute detailed information that can be linked with each paper feed unit includes information about surface characteristics of the paper managed using a column 3305, information about the shape of the paper managed using a column 3306, and information about the color of the paper managed using a column 3307. Furthermore, the information for determining whether the paper feed unit can be used in each of the first and second operations, which is managed using a column 3308, can be linked to the paper feed unit together with the detailed attribute information described above.

Thus, the selection between the first and second operations can be made for each paper feed unit under an environment in which information about the paper more detailed than in the case of the above-described configuration can be utilized.

A specific example of the printing system 1000 will now be further described below.

For example, when a job to be processed received by the printing apparatus 100 requires a printing medium of a specific type (for example, a special type printing medium other than a plain paper custom-designed by a printing medium manufacturer) in the print operation, the control unit 205 inhibits the printing system 1000 from performing the second operation for the job (this type of job is hereinafter referred to as a "first type job").

In addition, in this case, the control unit 205 allows the printing system 1000 to perform the first operation. Furthermore, when the productivity prioritization mode is previously set for the printing apparatus 100, the control unit 205 controls the printing system 1000 so that the printing system 1000 performs the first operation for the first type job.

On the other hand, when the control unit 205 receives a job that does not require such special kind (type) printing medium in the print operation (hereinafter referred to as a "second type job"), the control unit 205 permits the printing system 1000 to perform the second operation for the second type job.

The control unit 205 performs the control operation when the productivity prioritization mode is previously set for the printing apparatus 100. That is, when the productivity prioritization mode is not previously set for the printing apparatus 100, even when the control unit 205 receives the second type job, the control unit 205 allows the printing system 1000 to perform the first operation without performing the second operation.

With the above-described configuration, the following useful effects, for example, can be obtained.

That is, for example, a problem such that a plurality of paper feed units are wastefully and insignificantly occupied for one special print job requiring a special type printing medium for completely performing the print operation can be prevented. A special job such as the first type job can be handled as a job that is occasionally ordered from a customer.

In addition, a problem such that a printing medium required for a subsequent job waiting to be printed (for example, the second type job) cannot be made ready in the paper feed unit due to the special job can be prevented. Furthermore, a problem such that downtime affecting over a plurality of jobs wastefully and insignificantly occurs, which can be caused by shutdown of a system of the computer in which the first type job can be completely printed but the second type job cannot be completed and even the printing thereof cannot be started, can be prevented.

In the second operation, the control unit 205 recognizes that the remaining amount of printing media in one paper feed unit currently used in the print job to be processed has reached a specific amount. The specific amount is equivalent to the above-described predetermined amount.

That is, the specific amount is at least greater than zero and smaller than the maximum amount of storable printing media that can be set in one paper feed unit. The control unit 205 verifies that the remaining amount of printing medium has reached the specific amount according to the information from a sensor used for detecting the presence or absence of the printing media in the paper feed unit or the remaining amount thereof.

Thus, the control unit 205 allows the printing system 1000 to completely perform the print operation necessary for one job to be printed. In a case where a plurality of paper feed units are used in one job, the control unit 205 controls the printing system 1000 so that the printing system 1000 uses a paper feed unit in which a printing medium of a kind (type) required for the printing of the job is set.

That is, the control unit 205 controls the printing system 1000 so that a paper feed unit in which the paper media of a kind (type) required for the job to be processed is not set is determined not to be a paper feed unit to be used for the print operation of the job. In addition, in order to perform such control, the control unit 205 acquires the setting information about the printing media, of a plurality of print processing conditions set for the job by the user, while linking the setting information to the job at the time when a request for printing the job is generated by the user.

A specific example of the configuration of the printing system 1000 according to an exemplary embodiment will now be further described below. All of the plurality of paper feed units or at least one or more paper feed units included in the printing system 1000 (for example, the paper feed cassettes 317 and 318 and the paper feed deck 319) are key-equipped paper feed units. The key-equipped paper feed unit can include a physical key or an electronic locking function. The key-equipped paper feed unit can take an arbitrary shape and have arbitrary characteristics as long as the key-equipped paper feed unit can implement the configuration according to an exemplary embodiment.

For example, the printing system 1000 according to an exemplary embodiment includes a plurality of paper feed units corresponding to an electronic lock.

A first paper feed unit, in which the printing media required for the print operation of the job to be processed received by the printing apparatus 100, is a storage unit including the electronic lock and thus having a lock function. In this case, during the time period in which the printing media in the first paper feed unit are used to perform the print operation, the control unit 205 allows the first paper feed unit to remain locked and restricts (inhibits) opening and closing of the paper feed unit and performance of the operation for replenishing the printing media into the paper feed unit by the user.

When the printing media in the first paper feed unit becomes unnecessary for the print operation, the control unit 205 releases the lock of the first paper feed unit (opens the lock). During the time period in which the printing media in the first paper feed unit are not used in the print operation, the control unit 205 allows the first paper feed unit to remain open and permits the user to open and close the paper feed unit and to replenish the printing media into the paper feed unit.

Suppose that the control unit 205 allows the printing system 1000 to perform the second operation for one job to be processed With such a configuration. In addition, suppose that in order to complete the printing of one job, the control unit 205 allows the printing system 1000 to continue the print operation of the job using the printing media in a second paper feed unit, as another unit, after using the printing media in the first paper feed unit.

In this case, at the time when the paper feed unit to be used is switched from the first paper feed unit to the second paper feed unit to continue the print operation of the job, the control unit 205 releases the lock of the electronic lock of the first paper feed unit. During the time period in which the print operation of the job is continued using the printing media in the second paper feed unit to complete the printing of the job, the control unit 205 allows the user to replenish the printing media into the first paper feed unit.

In the control example, the control unit 205 allows the printing system 1000 to perform the second operation for the job. Accordingly, at the time of replenishment of the printing media in the first paper feed unit, printing media of the specific amount still remain in the first paper feed unit.

Suppose that when the second operation is performed by the printing system 1000 as described above, the printing media in the first paper feed unit is used first to complete the printing of the job to be processed. In addition, suppose that during the time in which the print operation of the job is being performed, the remaining amount of printing media in the first paper feed unit has reached the specific amount.

In this case, at this time, the control unit 205 releases the electronic lock of the first paper feed unit. In the first paper feed unit whose electronic lock has been released, the printing media of the specific amount still remain.

At the same time, the control unit 205 allows the printing system 1000 to continue the print operation of the job using the printing media in the second paper feed unit in the state where the printing media remaining in the first paper feed unit are not used and remaining.

Suppose that the print operation is currently performed using the second paper feed unit. In addition, suppose that in this state, the control unit 205 verifies that the user has replenished the printing media into the paper feed unit whose electronic lock has been released, before the remaining amount of printing media in the second paper feed unit reaches the amount equivalent to the specific amount.

The verification is performed by the control unit 205 according to the information from a sensor in the second paper feed unit.

When the verification is performed, the control unit 205 controls the printing system 1000 so that the printing system 1000 automatically continues the print operation of the job further using another paper feed unit in the state where the printing media of the specific amount remain in the second paper feed unit. However, when the second paper feed unit is used, the control unit 205 controls the printing system 1000 so that the printing system 1000 uses the first paper feed unit again without using a third paper feed unit other than the first and second paper feed units.

Suppose that during the time period in which the print operation of the job is continued using the second paper feed unit, the user has replenished the printing media into the first paper feed unit whose electronic lock is released. Thus, the printing media of an amount greater than the specific amount can be set in the first paper feed unit.

Suppose that during the time period in which the print operation is continued, the remaining amount of printing media in the second paper feed unit has reached the specific amount.

At this time, the control unit 205 controls the printing system 1000 so that the printing system 1000 can further continue the print operation of the job using the printing media in the first paper feed unit again without suspending the print operation, with the printing media in the second paper feed unit remaining. When the first paper feed unit is used in the job again, the control unit 205 controls the printing system 1000 so that the first paper feed unit is locked while the second paper feed unit is opened and that the user can replenish the printing media into the second paper feed unit.

As described above, the control unit 205 controls the printing system 1000 so that the above-described operations can be performed when the second operation is performed by the printing system 1000.

The specific amount can be, for example, 10% of the maximum amount of printing media that can be set in the paper feed unit. For example, in the case of the specific example, in the case where three thousand paper sheets can be set in the first paper feed unit at maximum, the specific amount for the first paper feed unit is three hundred.

In addition, in the specific example, in the case where five hundred paper sheets can be set in the second paper feed unit at maximum, the specific amount for the second paper feed unit is fifty. Thus, the specific amount in the second operation can be set in proportion to the maximum replenishment amount of the printing media in the paper feed unit to be used.

Alternatively, the configuration can be arranged such that when the remaining amount is ten paper sheets in both the first and second paper feed units, the switching to another paper feed unit can be performed. That is, the same specific amount (in this example, ten) can be applied regardless of which of the plurality of paper feed units used in the second operation is to be used.

In addition, the specific amount can be previously set by the user via the operation unit 204 as a device default setting via the screen illustrated in FIG. 14. As described above, as long as the remaining amount with which the print operation is not wastefully and insignificantly suspended in the printing system 1000 can be secured in the paper feed unit in performing the second operation, the specific amount can be arbitrarily defined.

With the above-described configuration, in the second operation, for example, printing of one job can be completed while using the same paper feed unit as possible without wastefully and insignificantly using a plurality of paper feed units. Thus, in the second operation, for example, if the control unit 205 receives a plurality of jobs that require mutually different types of printing media for the print operation, the control unit 205 can effectively process the jobs. With this specific example, the above-described useful effects can be obtained.

Suppose that during the time period in which the print operation is continued using the second paper feed unit in the second operation, the user does not replenish the printing media for the paper feed unit whose electronic lock is opened. The verification as to this replenishment is performed according to the information from the sensor of the paper feed unit.

In this case, the control unit 205 permits the printing system 1000 to continue the print operation of the job using printing media in another paper feed unit in the state where the printing media of the specific amount remain in the second paper feed unit. However, in this case, the control unit 205 inhibits the printing system 1000 from using the first paper feed unit again immediately after using the second paper feed unit.

In this case, the control unit 205 controls the printing system 1000 so that the printing system 1000 uses the third paper feed unit to complete printing of the job. The control unit 205 controls the printing system 1000 so that the printing system 1000 can further continue the print operation of the job using the printing media in the third paper feed unit without suspending the print operation in the state where the printing media of the specific amount remain in the second paper feed unit.

In continuing the print operation using the third paper feed unit, the control unit 205 controls the printing system 1000 so that the locks for the first and second paper feed units are opened while the third paper feed unit is locked.

The specific exemplary configuration of the printing system 1000 will now be further described below.

As described above, in a case where the second operation is performed by the printing system 1000, when the remaining amount of printing media in the first paper feed unit has reached the specific amount, the control unit 205 releases the electronic lock of the first paper feed unit. In this case, the control unit 205 controls the UI unit so that the UI unit requests the user to replenish the printing media into the first paper feed unit, in which the printing media of the specific amount remain.

For example, the control unit 205 displays a guidance and warning display screen including information for notifying the user that the remaining amount of printing media in the first paper feed unit has reached the specific amount on the UI unit according to an exemplary embodiment of the present invention. The control unit 205 controls the UI unit so that the guidance information includes the following information.

(i) That the printing system 1000 currently operates in the second operation.

(ii) That the print operation of the job is currently continued using the printing media in the second paper feed unit in the state where the printing media of the specific amount remain in the first paper feed unit used to complete printing of one job.

(iii) That the electronic lock of the first paper feed unit is released and that the printing media in the first paper feed unit can be taken out.

(iv) (By displaying the name of the printing media remaining in the first paper feed unit,) that the user should replenish into the first paper feed unit the printing media of the same kind (type) as the printing media remaining in the first paper feed unit.

The control unit 205 performs control so that when the remaining amount of printing media in the first paper feed unit has reached the specific amount, the guidance information including all of the information (i) through (iv) or including at least the information (iv) is notified to the user via the UI unit.

Thus, the user can easily and immediately recognize that the remaining amount of printing media in the first paper feed unit has reached the specific amount, that the electronic lock of the first paper feed unit has been released and the printing media can be replenished, and the name of the printing media that needs to be replenished. Thus, correct printing media can be replenished.

In notifying the information (iv) to the user, the cause for replenishing the printing media even when the printing media of the specific amount still remain can be notified to the user. For example, as the cause, it can be notified to the user that the second operation (the productivity prioritization mode) is set.

In this case, the control unit 205 displays the information including the information (iv) and the information (i) on the UI unit as the guidance information.

Thus, a problem such that the user who has been prompted to replenish printing media misunderstands that an error indicating that no paper remains occurs in the paper feed unit can be prevented. In addition, a problem such that the user is embarrassed by the message prompting the user to replenish printing media into the paper feed unit in which the printing media remain can be prevented.

In addition, a problem such that the user misunderstands that the apparatus is malfunctioning in this case can be prevented. Accordingly, in a case where the second operation is performed, the problems including misunderstanding and erroneous operation of the apparatus by the user can be prevented.

In an exemplary embodiment, whether the printing media remaining in the paper feed unit has reached the specific amount can be determined according to the number of remaining printing media in the paper feed unit, namely, according to the number of paper sheets remaining in the paper feed unit.

Alternatively, the configuration can be arranged such that each paper feed unit includes a height detection sensor for detecting a value of the amount of printing media remaining in the paper feed unit in the vertical direction, and the control unit 205 detects whether the remaining amount of printing media in one paper feed unit has reached the specific amount according to information from the height detection sensor.

As described above, the printing system 1000 can be applied to various modifications and advancements.

Furthermore, the information (i) through (iv) can be notified to the user as audio information.

As described above, the printing system 1000 can address the problems occurring in a conventional print system. In addition, the printing system 1000 is configured to establish a convenient and highly operable print environment that can correspond to a POD environment as well as to a business environment, for example.

Furthermore, the printing system 1000 can meets the needs in an actual work place in the print environment, such as a POD environment, such that a user desires to operate the system with a high productivity and that the work load on the user is desired to be decreased.

In addition, the printing system 1000 includes a unit for detecting that the remaining amount of print paper in the paper feed unit has reached the predetermined amount and that no print paper remains in the paper feed unit. Furthermore, the printing system 1000 includes two modes, namely, a mode in which printing is continued using print paper in another paper feed unit after print paper in a paper feed unit currently used for printing is completely consumed and a mode in which printing is continued using print paper in another paper feed unit before print paper in a paper feed unit currently used for printing is completely consumed.

The printing system 1000 switches between the modes according to the previously set information stored on the memory. Thus, various paper used in the POD environment can be effectively used while increasing the productivity per unit time and the entire productivity in a plurality of jobs.

The printing system 1000 according to an exemplary embodiment can continue the print operation using a plurality of paper feed units corresponding to the locking function. The control unit 205 controls the printing system 1000 so that regardless of whether the printing system 1000 performs the first operation or the second operation, the printing system 1000 keeps the locked state of the paper feed unit currently used for the print operation.

Furthermore, the control unit 205 controls the printing system 1000 so that the printing system 1000 releases the electronic lock of the paper feed unit that is set not to be used for the print operation at the time when the paper feed unit is set not to be used for the print operation. Moreover, the control unit 205 controls the printing system 1000 so that in performing the second operation with the printing system 1000, the printing system 1000 releases the electronic lock of the paper feed unit when the remaining amount of paper in the paper feed unit currently used for the print operation has reached the specific amount.

Accordingly, the user can quickly and immediately replenish printing media into a paper feed unit whose electronic lock has been released, and thus the print operation can be continued using the paper feed unit. Accordingly, with the above-described configuration, the print operation required for the job to be processed is not wastefully and insignificantly suspended, and thus downtime can be reduced. Furthermore, the paper feed unit can be effectively used without wastefully and insignificantly occupying a plurality of paper feed units.

The control unit 205 controls the printing system 1000 so that the printing system 1000 can complete the print operation of one job using a plurality of paper feed units in which the printing media of the same size and type are set, regardless of whether the first operation is performed or the second operation is performed. For example, the print operation using the first, second, and third paper feed units in one job is performed when the control unit 205 detects that the printing media of the size and type that match the size and type of the printing media existing in the first paper feed unit are set in the second and third paper feed units.

With the above-described configuration, a problem such that printing media of different sizes and types are mixedly used in outputting the same job, as a result of printing the job, which is not desired by the user, can be prevented. Furthermore, with the above-described configuration, the control unit 205 can receive, from the user via the UI unit, the setting for prioritizing the productivity with the operation of the key 2401 or 2602, the check box 2701, or the key 2902.

In the above-described configuration, provided that the setting has been performed, the control unit 205 allows the printing system 1000 to perform the second operation. However, the present exemplary embodiment is not limited to the above-described configuration.

That is, for example, the configuration can be arranged such that a specific setting for allowing the printing system 1000 to perform a specific operation corresponding to and similar to the second operation can be received from the user via the UI unit. In this case, the control unit 205 controls the printing system 1000 so that the printing system 1000 performs the specific operation when the setting is performed by the user.

This configuration is included in an exemplary embodiment as a modification thereof.

In the present exemplary embodiment, the printing system 1000 can selectively perform the first and second operations. However, the present exemplary embodiment is not limited to this configuration. That is, for example, the configuration can be arranged such that in a print system that cannot perform an operation similar to the first operation, the setting for allowing the printing system 1000 to perform a specific operation similar to the second operation can be received from the user via the UI unit. In this case, the control unit 205 performs control so that the print system can perform the specific operation. This configuration can be included in the present exemplary embodiment as another modification thereof.

In the case of such a configuration, it is more useful to implement a configuration such that a paper feed unit corresponding to the locking function described above can be used and the control unit 205 can perform a control operation equivalent to the control operation related to the locking and releasing of the key-equipped paper feed unit, which is performed in association with the operation for switching the paper feed units to be used in the second operation.

As described above, according to the printing system 1000 having the above-described configuration, a convenient and flexible print environment that can meet the various use cases and needs possibly occurring in the POD environment can be established. Furthermore, various methods suitable for marketing the system can be provided.

The structure and content of various data described above are not limited to those described above and can take various structures and have various contents according to the purpose of use.

An exemplary embodiment of the present invention is as described above. However, the present invention can be implemented in a system, an apparatus, a method, a program, and a storage medium storing the program. More specifically, the present invention can be applied to a system including a plurality of devices and to an apparatus that includes one device.

The configuration of a memory map of a storage medium storing various data processing programs that can be read by an information processing apparatus such as a computer (including the control unit 205 in the printing apparatus 100) according to an exemplary embodiment of the present invention is described with reference to a memory map illustrated in FIG. 26.

FIG. 26 illustrates a memory map of a storage medium (recording medium) that stores various data processing programs that can be read by such information processing apparatus according to an exemplary embodiment of the present invention.

Although not illustrated in FIG. 26, information for managing the programs stored in the storage medium, such as version information and information concerning the creator of a program, for example, can be stored in the storage medium. In addition, information that depends on an operating system (OS) of an apparatus that reads the program, such as an icon for identifying and displaying the program, can be stored in the storage medium.

In addition, data that is subordinate to the various programs is also managed in a directory of the storage medium. In addition, a program for installing the various programs on a computer can be stored in the storage medium. In addition, in a case where a program to be installed is compressed, a program for decompressing the compressed program can be stored in the storage medium.

In addition, the functions according to an exemplary embodiment can be implemented by a host computer (for example, the PC 103 or the PC 104) using a program that is externally installed.

In this case, data for displaying an operation screen similar to the operation screens including each operation screen described in the present exemplary embodiment is externally installed so that the above-described various user interface screens can be provided on a display unit of the host computer.

In the case of using such a configuration, the present invention is applied to the case where a group of information including a program is supplied to an output device from a storage medium, such as a compact disc read-only memory (CD-ROM), a flash memory, or a floppy disk (FD), or from an external storage medium through a network.

The present invention can also be achieved by providing a system or an apparatus with a storage medium storing program code of software implementing the functions of the embodiments and by reading and executing the program code stored in the storage medium with a computer of the system or the apparatus (a CPU or a micro processing unit (MPU)).

In this case, the program code itself, which is read from the storage medium, implements the functions of the embodiments described above, and accordingly, the storage medium storing the program code implements the present invention.

Accordingly, the program can be configured in any form, such as object code, a program executed by an interpreter, and script data supplied to an OS.

As the storage medium for supplying such program code, a flexible disk, a hard disk, an optical disk, a magneto-optical disk (MO), a CD-ROM, a CD-recordable (CD-R), a CD-rewritable (CD-RW), a magnetic tape, a nonvolatile memory card, a ROM, and a digital versatile disk (DVD), for example, can be used.

In this case, the program code itself, which is read from the storage medium, implements the function of the embodiments mentioned above, and accordingly, the storage medium storing the program code implements the present invention.

The above program can also be supplied by connecting to a web site on the Internet by using a browser of a client computer and by downloading the program from the web site to a storage medium such as a hard disk. In addition, the above program can also be supplied by downloading a compressed file that includes an automatic installation function from the web site to a storage medium such as a hard disk. The functions of the above embodiments can also be implemented by dividing the program code into a plurality of files and downloading each divided file from different web sites. That is, a world wide web (WWW) server and a file transfer protocol (FTP) server for allowing a plurality of users to download the program file for implementing the functional processing implement the present invention.

In addition, the above program can also be supplied by distributing a storage medium such as a CD-ROM and the like which stores the program according to an embodiment of the present invention after an encryption thereof, by allowing the user who is qualified for a prescribed condition to download key information for decoding the encryption from the web site via the Internet, and by executing and installing in the computer the encrypted program code by using the key information.

In addition, the functions according to the embodiments described above can be implemented not only by executing the program code read by the computer, but also implemented by the processing in which an OS or the like carries out a part of or the whole of the actual processing based on an instruction given by the program code.

Further, in another aspect of the embodiment of the present invention, after the program code read from the storage medium is written in a memory provided in a function expansion board inserted in a computer or a function expansion unit connected to the computer, a CPU and the like provided in the function expansion board or the function expansion unit carries out a part of or the whole of the processing to implement the functions of the embodiments described above.

Moreover, the present invention can be applied to a system including a plurality of devices and to an apparatus that includes one device. In addition, the present invention can be implemented by supplying the system or the apparatus with the program. In this case, by reading the storage medium storing the program represented by software for implementing the present invention with the system or the apparatus, the system or the apparatus can achieve the effect of the present invention.

In the present exemplary embodiment, the control unit 205 in the printing apparatus 100 is a main unit for performing the above-described various control operations. However, a part of or the whole of the various control operations can be performed with an external controller provided in a housing (apparatus body) separate from the printing apparatus 100.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application NO. 2006-182579 filed Jun. 30, 2006 and Japanese Patent Application NO. 2007-104455 filed Apr. 12, 2007, which are hereby incorporated by reference herein in their entirety.

What is claimed is:

1. A printing apparatus that feeds a sheet from one of a first sheet feeding unit and a second sheet feeding unit and performs printing on the sheet, the printing apparatus comprising:

a printing unit configured to perform printing;

a first receiving unit configured to receive a first setting for changing a feeding source of the sheet from the first sheet feeding unit independently of a job setting for a job for the first sheet feeding unit after an amount of sheets in the first sheet feeding unit reaches a predetermined non-zero amount while the printing unit performs the printing by continuously feeding sheets from the first sheet feeding unit and continue the printing;

a second receiving unit configured to receive a second setting for changing the feeding source of the sheet from the second sheet feeding unit and continue the printing independently of the job setting of the job for the second sheet feeding unit after the amount of sheets in the second sheet feeding unit reaches the predetermined non-zero amount while the printing unit performs the printing by continuously feeding sheets from the second sheet feeding unit and;

a storing unit configured to store the first setting received by the first receiving unit and the second setting received by the second receiving unit; and a control unit configured to change, in a case where the storing unit stores the first setting when the job is performed, the feeding source of the sheet from the first sheet feeding unit to another sheet feeding unit and continue the printing using the another sheet feeding unit after the amount of sheets in the first sheet feeding unit reaches the predetermined non-zero amount while the printing unit performs printing by continuously feeding sheets from the first sheet feeding unit, wherein the control unit continues, in a case where the storing unit does not store the second setting when the job is performed, the printing using the second sheet feeding unit after the amount of sheets in the second sheet feeding unit reaches the predetermined non-zero amount while the printing unit performs printing by continuously feeding sheets from the second sheet feeding unit.

2. The printing apparatus according to claim 1, wherein the control unit continues, in a case where the storing unit does not store the second setting when the job is performed, the printing using the second sheet feeding unit and then changes the feeding source of the sheet from the second sheet feeding unit to another sheet feeding unit when the amount of the sheets in the second sheet feeding unit reaches zero.

3. The printing apparatus according to claim 1, further comprising: a notification unit configured to urge a user to supply sheets in the first sheet feeding unit in a case where the control unit changes the feeding source of the sheet from the first sheet feeding unit to the another sheet feeding unit and continue the printing using the another sheet feeding unit after the amount of sheets in the first sheet feeding unit reaches the predetermined amount which is not zero while the printing unit performs printing using the first sheet feeding unit.

4. The printing apparatus according to claim 1, wherein the control unit changes, after the amount of sheets in the first sheet feeding unit reaches the predetermined non-zero amount while the printing unit performs printing by continuously feeding sheets from the first sheet feeding unit, the feeding source of the sheet from the first sheet feeding unit to another sheet feeding unit which stores a sheet having a size being the same as a size of the sheet in the first sheet feeding unit.

5. The printing apparatus according to claim 1, wherein the control unit changes, after the amount of sheets in the first sheet feeding unit reaches the predetermined non-zero amount while the printing unit performs printing by continuously feeding sheets from the first sheet feeding unit, the feeding source of the sheet from the first sheet feeding unit to another sheet feeding unit which stores a sheet having a type being the same as a type of the sheet in the first sheet feeding unit.

6. The printing apparatus according to claim 1, further comprising a detecting unit configured to detect that the amount of sheets in the first sheet feeding unit reaches the predetermined non-zero amount.

7. A control method for controlling a printing apparatus that feeds a sheet from one of a first sheet feeding unit and a second sheet feeding unit and performs printing on the sheet, the method comprising:

performing printing;

receiving a first setting for changing a feeding source of the sheet from the first sheet feeding unit independently of a job setting of a job for the first sheet feeding unit after an amount of sheets in the first sheet feeding unit reaches a predetermined non-zero amount while the printing is performed by continuously feeding sheets from the first sheet feeding unit and continue the printing;

receiving a second setting for changing the feeding source of the sheet from the second sheet feeding unit independently of the job setting of the job for the second sheet feeding unit after the amount of the sheets in the second sheet feeding unit reaches the predetermined amount which is not zero while the printing is performed by continuously feeding sheets from the second sheet unit and continue the printing;

storing the received first setting and the received second setting in a storing unit; and changing, in a case where the storing unit stores the first setting when the job is performed, the feeding source of the sheet from the first sheet feeding unit to another sheet feeding unit and continue the printing using the another sheet feeding unit after the amount of sheets in the first sheet feeding unit reaches the predetermined amount which is not zero while the printing is performed by continuously feeding sheets from the first sheet feeding unit;

wherein printing using the second sheet feeding unit is continued after the amount of sheets in the second sheet feeding unit reaches the predetermined amount which is not zero while printing is performed by continuously feeding sheets using the second sheet feeding unit in a case where the storing unit does not store the second setting when the job is performed.

8. A non-transitory computer-readable storage medium storing a program for causing a printing apparatus to execute a method for feeding a sheet from one of a first sheet feeding unit and a second sheet feeding unit and performing printing on the sheet, the program comprising:

a code to perform printing;

a code to receive a first setting for changing a feeding source of the sheet from the first sheet feeding unit independently of a job setting of a job for the first sheet feeding unit after an amount of sheets in the first sheet feeding unit reaches a predetermined non-zero amount while the printing unit performs the printing by continuously feeding sheets from the first sheet feeding unit and continue the printing;

a code to receive a second setting for changing the feeding source of the sheet from the second sheet feeding unit independent of the job setting of the job for the second sheet feeding unit while the printing unit performs the printing by continuously feeding sheets from the second feeding unit and continue the printing;

a code to change, in a case where the storing unit stores the first setting when the job is performed, the feeding source of the sheet from the first sheet feeding unit to another sheet feeding unit and continue the printing using the another sheet feeding unit after the amount of sheets in the first sheet feeding unit reaches the predetermined non-zero amount while the printing is performed by continuously feeding sheets from the first sheet feeding unit;

wherein, in a case where the storing unit does not store the second setting when the job is performed, printing using the second sheet feeding unit is continued after the amount of sheets in the second sheet feeding unit reaches the predetermined amount which is not zero while the printing is performed by continuously feeding sheets from the second sheet feeding unit.

* * * * *